US010477311B2

(12) United States Patent
Vilkamo

(10) Patent No.: US 10,477,311 B2
(45) Date of Patent: Nov. 12, 2019

(54) MERGING AUDIO SIGNALS WITH SPATIAL METADATA

(71) Applicant: Nokia Technologies Oy, Espoo (FI)

(72) Inventor: Juha T. Vilkamo, Helsinki (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/094,903

(22) PCT Filed: Apr. 19, 2017

(86) PCT No.: PCT/FI2017/050296
§ 371 (c)(1),
(2) Date: Oct. 19, 2018

(87) PCT Pub. No.: WO2017/182714
PCT Pub. Date: Oct. 26, 2017

(65) Prior Publication Data

US 2019/0132674 A1 May 2, 2019

(51) Int. Cl.
*H04R 3/00* (2006.01)
*H04S 3/00* (2006.01)
(Continued)

(52) U.S. Cl.
CPC ..... *H04R 3/005* (2013.01); *G10L 25/18* (2013.01); *H04R 5/027* (2013.01); *H04R 5/04* (2013.01);
(Continued)

(58) Field of Classification Search
CPC ..... H04R 5/027; H04R 3/005; H04R 1/406; H04R 5/04; H04R 2430/23;
(Continued)

(56) References Cited

U.S. PATENT DOCUMENTS 9,883,309 B2 * 1/2018 Sannuelsson ..... G10L 21/00
2008/0008323 A1 1/2008 Hilpert et al. ..... 381/1
(Continued)

FOREIGN PATENT DOCUMENTS

EP 2375779 A2 10/2011
WO WO-2014/096900 A1 6/2014
WO WO-2016/049106 A1 3/2016

*Primary Examiner* — Paul Kim
(74) *Attorney, Agent, or Firm* — Harrington & Smith

(57) ABSTRACT

Apparatus for mixing at least two audio signals, at least one audio signal associated with at least one parameter, and at least one second audio signal further associated with at least one second parameter, wherein the at least one audio signal and the at least one second audio signal are associated with a sound scene and wherein the at least one audio signal represent spatial audio capture microphone channels and the at least one second audio signal represents an external audio channel separate from the spatial audio capture microphone channels, the apparatus comprising: a processor configured to generate a combined parameter output based on the at least one second parameter and the at least one parameter; and a mixer configured to generate a combined audio signal with a same number or fewer number of channels as the at least one audio signal based on the at least one audio signal and the at least one second audio signal, wherein the combined audio signal is associated with the combined parameter.

20 Claims, 10 Drawing Sheets

(51) Int. Cl.

| | |
|---|---|
| ***G10L 25/18*** | (2013.01) |
| ***H04R 5/027*** | (2006.01) |
| ***H04R 5/04*** | (2006.01) |
| *H04R 1/40* | (2006.01) |
| *H04S 7/00* | (2006.01) |

(52) U.S. Cl.
CPC ..... *H04S 3/00* (2013.01); *H04R 1/406* (2013.01); *H04R 2430/23* (2013.01); *H04S 7/00* (2013.01); *H04S 2400/11* (2013.01); *H04S 2400/15* (2013.01)

(58) Field of Classification Search
CPC .... H04S 2400/15; H04S 3/00; H04S 2400/11; H04S 7/00; G10L 25/18
USPC ..... 381/26
See application file for complete search history.

(56) References Cited

U.S. PATENT DOCUMENTS

| | | | | |
|---|---|---|---|---|
| 2009/0313028 | A1 | 12/2009 | Tammi et al. | 704/500 |
| 2011/0216908 | A1 | 9/2011 | Galdo et al. | 381/17 |
| 2015/0319530 | A1 | 11/2015 | Virolainen et al. | H04R 5/02 |

* cited by examiner

MERGING AUDIO SIGNALS WITH SPATIAL METADATA

This patent application is a U.S. National Stage application of International Patent Application Number PCT/FI2017/050296 filed Apr. 19, 2017, which is hereby incorporated by reference in its entirety, and claims priority to GB 1607037.7 filed Apr. 22, 2016.

FIELD

The present application relates to apparatus and methods for merging audio signals with spatial metadata. The invention further relates to, but is not limited to, apparatus and methods for distributed audio capture and mixing for spatial processing of audio signals to enable the generation of data-efficient representations suitable for spatial reproduction of audio signals.

BACKGROUND

A typical approach to stereo and surround audio transmission is loudspeaker-channel-based. In such, the stereo content or horizontal surround or 3D surround content is produced, encoded, and transmitted as a group of individual channels to be decoded and reproduced at the receiver end. A straightforward method is to encode each of the channels individually, for example, using MPEG Advanced Audio Coding (AAC), which is a common approach in commercial systems. More recently, bit-rate efficient multi-channel audio coding systems have emerged, such as MPEG Surround and that in MPEG-H Part 3: 3D Audio. They employ methods to combine the audio channels to a lesser number of audio channels for transmission. Alongside the lesser number of audio channels, dynamic spatial metadata is transmitted, which effectively has the information how to re-synthesize a multi-channel audio signal having a close perceptual resemblance to the original multi-channel signal. Such audio coding can be referred to as parametric multi-channel audio coding.

Some of the parametric spatial audio coding systems, such as MPEG-H Part 3: 3D audio, provide also an option to transmit audio objects, which are audio channels with a potentially dynamically changing location. The audio objects can be reproduced, for example, using amplitude panning techniques at the receiver end. It can be considered that for professional multi-channel audio productions the aforementioned techniques are well suited.

The use case of virtual reality (VR) audio (definition here including array-captured spatial audio and augmented reality audio) is typically fundamentally different. In specific, it is typical that the audio content is fully or partly retrieved from an array of microphones integrated to the presence capture device, such as a spherical multi-lens camera, or an array near the camera. The audio capture techniques in this context differ from classical recording techniques. For example, in a manner similar to a radar or radio communication, it is possible to use array signal processing techniques for audio signals to detect information of the sound scene that has perceptual significance. This includes the direction(s) of the arriving sounds (sometimes coinciding with the directions of the sources in the scene), and the ratios between the directional energy, and other kinds of sound energy, such as background ambience, reverberation, noise, or similar. Such, or similar parameters we refer to as dynamic spatial audio capture (SPAC) metadata. There exist several known methods of array signal processing to estimate SPAC metadata. In contrast to classical loudspeaker-channel based systems, in this case the direction can be any spatial direction, and there may be no resemblance with respect to any particular loudspeaker setup. A digital signal processing (DSP) system can be implemented to use this metadata and the microphone signals to synthesize the spatial sound perceptually accurately to any surround or 3D surround setup, or to headphones by applying binaural processing techniques. There exist several high-quality options for the DSP systems to perform such rendering. We refer to such a process as SPAC rendering. It is to be noted that the SPAC metadata, SPAC rendering, and the efficient multi-channel audio coding are always performed in frequency bands, because the human spatial hearing is known to decode the spatial image based on spatial information in frequency bands.

A traditional and straightforward approach for SPAC audio transmission would be to perform the SPAC rendering to produce a 3D-surround mix, and to apply the multi-channel audio coding techniques to transmit the audio. However, this approach is not optimal. Firstly, for headphone binaural rendering, applying an intermediate loudspeaker layout inevitably means using amplitude panning techniques, because the sources do not coincide with the directions of the loudspeakers. With headphone binaural use, which is the main use case of VR audio, we do not need to restrict the decoding in such a way. A sound can be decoded at any directions using a high-resolution set of head-related transfer functions (HRTFs). Amplitude-panned sources are perceived less point-like and often also spectrally imbalanced when compared to direct HRTF rendering. Secondly, having sufficient reproduction in 3D using the intermediate loudspeaker representation, we need to transmit a high number of audio channels. The modern multi-channel audio coding techniques mitigate this effect by combining the audio channels, however, applying such methods in minimum adds layers of unnecessary audio processing steps, which at least reduces the computational efficiency, but potentially also audio fidelity.

The Nokia VR Audio format, for which the methods described herein are relevant, is defined specifically for VR use. The SPAC metadata itself is transmitted alongside a set of audio channels obtained from microphone signals. The SPAC decoding takes place at the receiver end to the given setup, being loudspeakers or headphones. Thus, the audio can be decoded as point-like sources at any direction, and the computational overhead is minimum. Furthermore, the format is defined to support various microphone-array types supporting different levels of spatial analysis. For example, with some array processing techniques one can accurately analyse a single prominent spectrally overlapping source, while other techniques can detect two or more, which can provide perceptual benefit at complex sound scenes. Thus, the VR-audio format is defined flexible with respect to the number of simultaneous analysed directions. This feature of Nokia's VR audio format is the most relevant for the methods described herein. For completeness, the VR audio format also provides support for transmission of other signal types such as audio-object signals and loudspeaker signals as additional tracks with separate audio-channel based spatial metadata.

The present methods focus on reducing or limiting the number of transmitted audio channels in context of VR audio transmission. As a key feature, the present methods take advantage of the aforementioned flexible definition of the spatial audio capture (SPAC) metadata in Nokia VR audio format. As an overview, the present methods allow to mix in additional audio channel(s) such as audio object signals within the SPAC signals, in such a way that the number of the channels is not increased. However, the processing is formulated such that the spatial fidelity is well preserved. This property is obtained with taking benefit of the flexible definition of the number of simultaneous SPAC directions. The added signals add layers to the SPAC metadata as simultaneous directions being potentially different from the original existing SPAC directions. As the result, the merged SPAC stream is such that has both the original microphone-captured audio signals as well as the in-mixed audio signals, and the spatial metadata is expanded to cover both. As the result, the merged SPAC stream can be decoded at the receiver side with the high spatial fidelity.

It is to be noted here that an existing technical alternative to merging the SPAC and other streams, for example an audio object, would be to process and add the audio-object signal to the microphone-array signals in such a way that it resembles a plane wave arriving to the array from the specified direction of the object. However, it is well known in the field of array signal processing that having simultaneous spectrally overlapping sources at the sound scene makes the spatial analysis less reliable, which typically affects the spatial precision of the decoded sound. As another alternative, the object signals could be also transmitted as additional audio tracks, and rendered at the receiver end. This solution yields better reproduction quality, but also a higher number of transmitted channels, i.e., higher bit rate and higher computational load at the decoder.

Thus, there is a need to develop solutions which enable a high quality rendering process without a significantly higher computational loading/storage and transmission capacity requirements found in the prior art.

In the following the background is given for a use case in which SPAC and audio objects are used simultaneously. Capture of audio signals from multiple sources and mixing of those audio signals when these sources are moving in the spatial field requires significant effort. For example the capture and mixing of an audio signal source such as a speaker or artist within an audio environment such as a theatre or lecture hall to be presented to a listener and produce an effective audio atmosphere requires significant investment in equipment and training.

A commonly implemented system would be for a professional producer to utilize an external or close microphone, for example a Lavalier microphone worn by the user or a microphone attached to a boom pole to capture audio signals close to the speaker or other sources, and then manually mix this captured audio signal with a suitable spatial (or environmental or audio field) audio signal such that the produced sound comes from an intended direction. As would be expected manually positioning a sound source within the spatial audio field requires significant time and effort to do.

Modern array signal processing techniques have emerged that enable, instead of manual recording, an automated recording of spatial scenes, and perceptually accurate reproduction using loudspeakers or headphones. However, in such recording, often it is necessary to enhance the audio signals. For example the audio signals may be enhanced for clarification of information or intelligibility purposes. Thus, in a news broadcast, the end user may like to get more clarity on the audio from news reporter rather than any background 'noise'.

SUMMARY

There is provided according to a first aspect an apparatus for mixing at least two audio signals, the at least two audio signals associated with at least one parameter, and at least one second audio signal further associated with at least one second parameter, wherein the at least two audio signals and the at least one second audio signal are associated with a sound scene and wherein the at least two audio signals represent spatial audio capture microphone channels and the at least one second audio signal represents an external audio channel separate from the spatial audio capture microphone channels, the apparatus comprising: a processor configured to generate a combined parameter output based on the at least one second parameter and the at least one parameter; and a mixer configured to generate a combined audio signal with a same number or fewer number of channels as the at least one audio signal based on the at least two audio signals and the at least one second audio signal, wherein the combined audio signal is associated with the combined parameter.

At least one of the mixer or a further processor for audio signal mixing may be configured to generate at least one mix audio signal based on the at least one second audio signal in order to generate the combined audio signals based on the at least one mix audio signal.

The at least one parameter may comprise at least one of: at least one direction associated with the at least two audio signals; at least one direction associated with a spectral band portion of the at least two audio signals; at least one signal energy associated with the at least two audio signals; at least one signal energy associated with a spectral band portion of the at least two audio signals; at least one metadata associated with the at least two audio signals; and at least one signal energy ratio associated with a spectral band portion of the at least two audio signals.

The at least one second parameter may comprise at least one of: at least one direction associated with the at least one second audio signal; at least one direction associated with a spectral band portion of the at least one second audio signal; at least one signal energy associated with the at least one second audio signal; at least one signal energy associated with a spectral band portion of the at least one second audio signal; at least one signal energy ratio associated with the at least one second audio signal; at least one metadata associated with the at least one second audio signal; and at least one signal energy ratio associated with a spectral band portion of the at least one second audio signal.

The apparatus may further comprise an analyser configured to determine the at least one second parameter.

The analyser may be further configured to determine the at least one parameter.

The analyser may comprise a spatial audio analyser configured to receive the at least two audio signals and determine the at least one direction associated with the at least two audio signals and/or the spectral band portion of the at least one audio signal.

The processor may be configured to append the at least one direction associated with the at least one second audio signal and/or the spectral band portion of the at least one second audio signal to the at least one direction associated with the at least two audio signals and/or the spectral band portion of the at least two audio signals to generate combined spatial audio information.

The analyser may comprise an audio signal energy analyser configured to receive the at least two audio signals and determine the at least one signal energy and/or at least one signal energy ratio associated with the at least two audio signals and/or the spectral band portion of the at least two audio signals, wherein the at least one signal energy parameter and/or at least one signal energy ratio may be associated with the determined at least one direction.

The apparatus may further comprise a signal energy analyser configured to receive the at least one second audio signal and determine the at least one signal energy and/or at least one signal energy ratio, associated with the at least one second audio signal and/or the spectral band portion of the at least one second audio signal.

The processor may be configured to append the at least one signal energy and/or at least one signal energy ratio associated with the at least one second audio signal and/or the spectral band portion of the at least one second audio signal to the at least one signal energy and/or at least one signal energy ratio associated with the at least two audio signals and/or the spectral band portion of the at least one audio signal to generate combined signal energy information.

The at least one of the processor or the mixer or the further processor for audio signal mixing may be configured to generate the at least one mix audio signal further based on the at least one signal energy associated with the at least one second audio signal and the at least one signal energy associated with the at least two audio signals.

The apparatus may further comprise an audio signal processor configured to receive the at least two audio signals and generate a pre-processed audio signal before being received by the mixer.

The audio signal processor may be configured to generate a downmix signal.

The apparatus may further comprise a microphone arrangement configured to generate the at least two audio signals, wherein locations of the microphone may be defined relative to a defined location.

The at least one of the processor or the mixer or the further processor for audio signal mixing may be configured to generate the at least one mix audio signal to simulate a sound wave arriving at the locations of the microphones from the at least one direction associated with the at least one second audio signal and/or spectral band portion of the at least one second audio signal relative to the defined location.

The defined location may be a location of a capture apparatus comprising an array of microphones configured to generate the at least one audio signal.

The at least one second audio signal may be generated by an external microphone, wherein the at least one direction associated with the at least one second audio signal and/or spectral band portion of the at least one second audio signal is the direction of the external microphone relative to the defined location.

The external microphone may comprise a radio transmitter configured to transmit a radio signal, the apparatus may comprise a radio receiver configured to receive the radio signal and a direction determiner may be configured to determine the direction of the external microphone relative to the defined location.

The mixer may be configured to generate the combined audio signal based on adding the at least one second audio signal to one or more channels of the at least two audio signals.

The at least two audio signals representing spatial audio capture microphone channels may be received live from a microphone array and the at least one second audio signal representing an external audio channel separate from the spatial audio capture microphone channels may be received live from at least one second microphone external to the microphone array.

The at least two audio signals representing spatial audio capture microphone channels may be received from a previously stored microphone array and the at least one second audio signal representing an external audio channel separate from the spatial audio capture microphone channels may be received from a previously stored at least one second microphone external to the microphone array.

The at least two audio signals representing spatial audio capture microphone channels may be synthesized audio signals and the at least one second audio signal representing an external audio channel separate from the spatial audio capture microphone channels may be at least one second synthesized audio signal external to the at least two synthesized audio signals.

The at least two audio signals representing spatial audio capture microphone channels may be received from a microphone array and the at least one second audio signal representing an external audio channel separate from the spatial audio capture microphone channels may be received from a further microphone array.

The at least two audio signals representing spatial audio capture microphone channels may be synthesized microphone array audio signals and the at least one second audio signal representing an external audio channel separate from the spatial audio capture microphone channels may be received from at least one microphone external to the synthesized microphone array.

The at least two audio signals representing spatial audio capture microphone channels may be received from a microphone array and the at least one second audio signal representing an external audio channel separate from the spatial audio capture microphone channels may be a synthesized audio signal external to the microphone array.

According to a second aspect there is provided a method for mixing at least two audio signals, the at least two audio signals associated with at least one parameter, and at least one second audio signal further associated with at least one second parameter, wherein the at least two audio signals and the at least one second audio signal are associated with a sound scene and wherein the at least two audio signals represent spatial audio capture microphone channels and the at least one second audio signal represents an external audio channel separate from the spatial audio capture microphone channels, the method comprising: generating a combined parameter output based on the at least one second parameter and the at least one parameter; and generating a combined audio signal with a same number or fewer number of channels as the at least one audio signal based on the at least two audio signals and the at least one second audio signal, wherein the combined audio signal is associated with the combined parameter.

The method may comprise generating at least one mix audio signal based on the at least one second audio signal in order to generate the combined audio signals based on the at least one mix audio signal.

The at least one parameter may comprise at least one of: at least one direction associated with the at least two audio signals; at least one direction associated with a spectral band portion of the at least two audio signals; at least one signal energy associated with the at least two audio signals; at least one signal energy associated with a spectral band portion of the at least two audio signals; at least one metadata associated with the at least two audio signals; and at least one signal energy ratio associated with a spectral band portion of the at least two audio signals.

The at least one second parameter may comprise at least one of: at least one direction associated with the at least one second audio signal; at least one direction associated with a spectral band portion of the at least one second audio signal; at least one signal energy associated with the at least one second audio signal; at least one signal energy associated with a spectral band portion of the at least one second audio signal; at least one signal energy ratio associated with the at least one second audio signal; at least one metadata associated with the at least one second audio signal; and at least one signal energy ratio associated with a spectral band portion of the at least one second audio signal.

The method may further comprise determining the at least one second parameter.

The method may further comprise determining the at least one parameter.

Determining the at least one parameter may comprise receiving the at least two audio signals and determining the at least one direction associated with the at least two audio signals and/or the spectral band portion of the at least one audio signal.

The method may comprise appending the at least one direction associated with the at least one second audio signal and/or the spectral band portion of the at least one second audio signal to the at least one direction associated with the at least two audio signals and/or the spectral band portion of the at least two audio signals to generate combined spatial audio information.

Determining the at least one second parameter may comprise receiving the at least two audio signals and determining the at least one signal energy and/or at least one signal energy ratio associated with the at least two audio signals and/or the spectral band portion of the at least two audio signals, wherein the at least one signal energy parameter and/or at least one signal energy ratio may be associated with the determined at least one direction.

The method may comprise determining the at least one signal energy and/or at least one signal energy ratio, associated with the at least one second audio signal and/or the spectral band portion of the at least one second audio signal.

The method may comprise appending the at least one signal energy and/or at least one signal energy ratio associated with the at least one second audio signal and/or the spectral band portion of the at least one second audio signal to the at least one signal energy and/or at least one signal energy ratio associated with the at least two audio signals and/or the spectral band portion of the at least one audio signal to generate combined signal energy information.

The method may comprise generating the at least one mix audio signal further based on the at least one signal energy associated with the at least one second audio signal and the at least one signal energy associated with the at least two audio signals.

The method may further comprise generating a preprocessed audio signal from the at least two audio signals before mixing.

The method may comprise generating a downmix signal.

The method may further comprise providing a microphone arrangement configured to generate the at least two audio signals, wherein locations of the microphone arrangement may be defined relative to a defined location.

The method may comprise generating the at least one mix audio signal to simulate a sound wave arriving at the locations of the microphones from the at least one direction associated with the at least one second audio signal and/or spectral band portion of the at least one second audio signal relative to the defined location.

The defined location may be a location of a capture apparatus comprising an array of microphones configured to generate the at least one audio signal.

The at least one second audio signal may be generated by an external microphone, wherein the at least one direction associated with the at least one second audio signal and/or spectral band portion of the at least one second audio signal is the direction of the external microphone relative to the defined location.

The external microphone may comprise a radio transmitter configured to transmit a radio signal, the apparatus may comprise a radio receiver configured to receive the radio signal and a direction determiner may be configured to determine the direction of the external microphone relative to the defined location.

The mixing may comprise generating the combined audio signal based on adding the at least one second audio signal to one or more channels of the at least two audio signals.

The at least two audio signals representing spatial audio capture microphone channels may be received live from a microphone array and the at least one second audio signal representing an external audio channel separate from the spatial audio capture microphone channels may be received live from at least one second microphone external to the microphone array.

The at least two audio signals representing spatial audio capture microphone channels may be received from a previously stored microphone array and the at least one second audio signal representing an external audio channel separate from the spatial audio capture microphone channels may be received from a previously stored at least one second microphone external to the microphone array.

The at least two audio signals representing spatial audio capture microphone channels may be synthesized audio signals and the at least one second audio signal representing an external audio channel separate from the spatial audio capture microphone channels may be at least one second synthesized audio signal external to the at least two synthesized audio signals.

The at least two audio signals representing spatial audio capture microphone channels may be received from a microphone array and the at least one second audio signal representing an external audio channel separate from the spatial audio capture microphone channels may be received from a further microphone array.

The at least two audio signals representing spatial audio capture microphone channels may be synthesized microphone array audio signals and the at least one second audio signal representing an external audio channel separate from the spatial audio capture microphone channels may be received from at least one microphone external to the synthesized microphone array.

The at least two audio signals representing spatial audio capture microphone channels may be received from a microphone array and the at least one second audio signal representing an external audio channel separate from the spatial audio capture microphone channels may be a synthesized audio signal external to the microphone array.

According to third aspect there is provided an apparatus for mixing at least two audio signals, the at least two audio signals associated with directional information relative to a defined location, and further associated with at least one parameter, and at least one second audio signal associated with further directional information relative to the defined location and further associated with at least one further parameter, wherein the at least two audio signals and the at least one second audio signal are associated with a sound scene and wherein the at least two audio signals represent spatial audio capture microphone channels and the at least one second audio signal represents an external audio channel separate from the spatial audio capture microphone channels, the apparatus comprising:

means for generating a combined parameter output based on the at least one second parameter and the at least one parameter; and means for generating a combined audio signal with a same number or fewer number of channels as the at least one audio signal based on the at least two audio signals and the at least one second audio signal, wherein the combined audio signal is associated with the combined parameter.

The apparatus may comprise means for generating at least one mix audio signal based on the at least one second audio signal in order to generate the combined audio signals based on the at least one mix audio signal.

The at least one parameter may comprise at least one of: at least one direction associated with the at least two audio signals; at least one direction associated with a spectral band portion of the at least two audio signals; at least one signal energy associated with the at least two audio signals; at least one signal energy associated with a spectral band portion of the at least two audio signals; at least one metadata associated with the at least two audio signals; and at least one signal energy ratio associated with a spectral band portion of the at least two audio signals.

The at least one second parameter may comprise at least one of: at least one direction associated with the at least one second audio signal; at least one direction associated with a spectral band portion of the at least one second audio signal; at least one signal energy associated with the at least one second audio signal; at least one signal energy associated with a spectral band portion of the at least one second audio signal; at least one signal energy ratio associated with the at least one second audio signal; at least one metadata associated with the at least one second audio signal; and at least one signal energy ratio associated with a spectral band portion of the at least one second audio signal.

The apparatus may further comprise means for determining the at least one second parameter.

The apparatus may further comprise means for determining the at least one parameter.

The means for determining the at least one parameter may comprise means for receiving the at least two audio signals and means for determining the at least one direction associated with the at least two audio signals and/or the spectral band portion of the at least one audio signal.

The apparatus may comprise means for appending the at least one direction associated with the at least one second audio signal and/or the spectral band portion of the at least one second audio signal to the at least one direction associated with the at least two audio signals and/or the spectral band portion of the at least two audio signals to generate combined spatial audio information.

The means for determining the at least one second parameter may comprise means for receiving the at least two audio signals and means for determining the at least one signal energy and/or at least one signal energy ratio associated with the at least two audio signals and/or the spectral band portion of the at least two audio signals, wherein the at least one signal energy parameter and/or at least one signal energy ratio may be associated with the determined at least one direction.

The apparatus may comprise means for determining the at least one signal energy and/or at least one signal energy ratio, associated with the at least one second audio signal and/or the spectral band portion of the at least one second audio signal.

The apparatus may comprise means for appending the at least one signal energy and/or at least one signal energy ratio associated with the at least one second audio signal and/or the spectral band portion of the at least one second audio signal to the at least one signal energy and/or at least one signal energy ratio associated with the at least two audio signals and/or the spectral band portion of the at least one audio signal to generate combined signal energy information.

The apparatus may comprise means for generating the at least one mix audio signal further based on the at least one signal energy associated with the at least one second audio signal and the at least one signal energy associated with the at least two audio signals.

The apparatus may further comprise means for generating a pre-processed audio signal from the at least two audio signals before mixing.

The apparatus may comprise means for generating a downmix signal.

The apparatus may further comprise means for providing a microphone arrangement configured to generate the at least two audio signals, wherein locations of the microphone arrangement may be defined relative to a defined location.

The apparatus may comprise means for generating the at least one mix audio signal to simulate a sound wave arriving at the locations of the microphones from the at least one direction associated with the at least one second audio signal and/or spectral band portion of the at least one second audio signal relative to the defined location.

The defined location may be a location of a capture apparatus comprising an array of microphones configured to generate the at least one audio signal.

The at least one second audio signal may be generated by an external microphone, wherein the at least one direction associated with the at least one second audio signal and/or spectral band portion of the at least one second audio signal is the direction of the external microphone relative to the defined location.

The external microphone may comprise a radio transmitter configured to transmit a radio signal, the apparatus may comprise a radio receiver configured to receive the radio signal and a direction determiner may be configured to determine the direction of the external microphone relative to the defined location.

The mixing may comprise generating the combined audio signal based on adding the at least one second audio signal to one or more channels of the at least two audio signals.

The at least two audio signals representing spatial audio capture microphone channels may be received live from a microphone array and the at least one second audio signal representing an external audio channel separate from the spatial audio capture microphone channels may be received live from at least one second microphone external to the microphone array.

The at least two audio signals representing spatial audio capture microphone channels may be received from a previously stored microphone array and the at least one second audio signal representing an external audio channel separate from the spatial audio capture microphone channels may be received from a previously stored at least one second microphone external to the microphone array.

The at least two audio signals representing spatial audio capture microphone channels may be synthesized audio signals and the at least one second audio signal representing an external audio channel separate from the spatial audio capture microphone channels may be at least one second synthesized audio signal external to the at least two synthesized audio signals.

The at least two audio signals representing spatial audio capture microphone channels may be received from a microphone array and the at least one second audio signal representing an external audio channel separate from the spatial audio capture microphone channels may be received from a further microphone array.

The at least two audio signals representing spatial audio capture microphone channels may be synthesized microphone array audio signals and the at least one second audio signal representing an external audio channel separate from the spatial audio capture microphone channels may be received from at least one microphone external to the synthesized microphone array.

The at least two audio signals representing spatial audio capture microphone channels may be received from a microphone array and the at least one second audio signal representing an external audio channel separate from the spatial audio capture microphone channels may be a synthesized audio signal external to the microphone array.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

The following describes in further detail suitable apparatus and possible mechanisms for the provision of audio object mixing for channel and bit-rate reduction. The audio objects may be audio sources determined from captured audio signals. In the following examples, audio object mixing generated from audio signals and audio capture signals are described.

The following embodiments of the methods are described herein. Firstly, an embodiment is described in which an audio object signal is merged to the microphone-array originating signals. In the embodiment, the SPAC metadata related to the microphone-array signals originally has one direction at each time-frequency instance. Along the merging process the metadata is expanded with a second simultaneous direction of the in-mixed audio-object signal. The energy-ratio parameters within the SPAC metadata are processed to account for the added energy of the audio-object signal.

Figure 1:
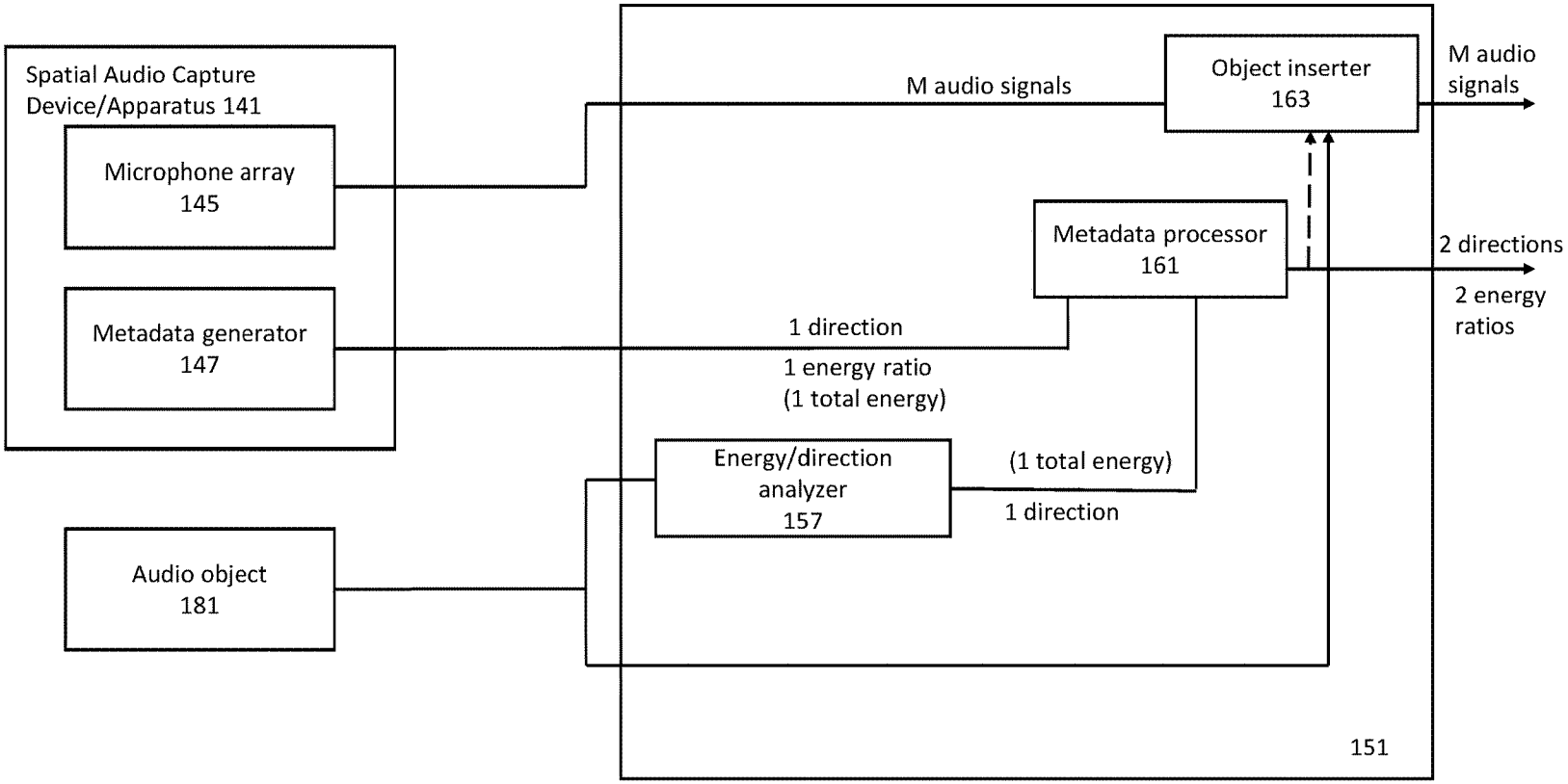
FIGS. 1 to 6 shows schematically apparatus suitable for implementing embodiments.

With respect to FIG. 1 an example system of apparatus for implementing such an embodiment is shown. In this example the system may comprise a spatial audio capture (SPAC) device 141, for example an omni-directional content capture (OCC) device. The spatial audio capture device 141 may comprise a microphone array 145. The microphone array 145 may be any suitable microphone array for capturing spatial audio signals. The microphone array 145 may, for example be configured to output M' audio signals. For example M' may be the number of microphone elements within the array (in other words the microphone array is configured to output a digitally unprocessed output). However it is understood that the microphone array 145 may be configured to output at least one audio signal in any suitable spatial audio format (such as the B-format or a subset of the microphone signals) and thus may comprise a microphone processor to process the microphone audio signals into the at least one audio signal in the output format.

The at least one audio signal may be associated with spatial metadata. The spatial metadata associated with the at least one audio signal may contain directional information with respect to the SPAC device. The SPAC device 141 may comprise a metadata generator 147 configured to generate this metadata from the microphone array 145 signals. For example the audio signals from the microphone array may be analysed using array signal processing methods taking benefit of the differences in relative positions of the microphones in the array of microphones. The metadata may contain a parameter defining at least one direction associated with the at least one audio signal and be generated based on relative phase/time differences and/or the relative energies of the microphone signals. As with all discussed signal properties, these properties may and typically are analysed in frequency bands. For example the SPAC metadata related to the microphone-array signals may have one direction at each time-frequency instance. The metadata generator 147 may obtain frequency-band signals from the microphone array 145 using a short-time Fourier transform or any other suitable filter bank. The frequency-band signals may be analysed in frequency groups approximating perceptually determined frequency bands (e.g. Bark bands, Equivalent rectangular bands (ERB), or similar). The frequency bands, or the frequency-band groups can be analysed in time frames or otherwise adaptively in time. The aforementioned time-frequency considerations apply to all embodiments in the scope. From these time and frequency divided audio signals the metadata generator 147 may generate the direction/spatial metadata representing perceptually relevant qualities of the sound field. The metadata may contain directional information pointing to an approximate direction towards an area of directions from where a large proportion of the sound arrives at that time and for that frequency band. Furthermore the metadata generator 147 may be configured to determine other parameters such as a direct to total energy ratio associated with the identified direction, and the overall energy which is a parameter required by the consequent merging processes. In the example shown 1 direction is identified for each band. However in some embodiments the number of determined directions may be more than one. For any time period (or instance) the spatial analyser may be configured to identify or determine: a SPAC direction relative to the microphone array 145 for each frequency band; an associated ratio of the energy of the SPAC direction (or modelled audio source) to the total energy of the microphone audio signals and the total energy parameters. The directions and the energy levels may vary between measurements as they will reflect the ambience of the audio scene.

The direction (and energy ratio) may model an audio source (which may not be the physical audio source as provided by the external microphone or synthetic object). The time period (or interval in time) and similarly the frequency intervals where the analysis takes place may relate to human spatial hearing mechanisms.

In this embodiment and the following embodiments it may be understood that the energy related parameters which are determined from the SPAC audio signals may be the ratio of the energy of the SPAC direction to the total energy of the microphone audio signals which may be passed to the metadata processor and which is combined as discussed herein and passed to a suitable decoder, audio processor or renderer. The total energy level may also be determined and passed to the metadata processor 161. The total energy (of the SPAC device audio signals) may be encoded and passed to the decoder, however, the total energy most importantly is used (together with the energy level determined from the audio object audio signals and the energy ratio parameters) in order to process appropriate energy ratio parameters for the merged audio signals. This is since the energies of the input signals with respect to each other (the audio object and the SPAC device) affect the corresponding energetic proportions at the merged signals. As a specific numeric example in one configuration, if two input signals are merged, the first having for example a ratio parameter of 0.5 (the remainder is ambience) and overall energy of 1, and the second has a ratio parameter of 1 (no ambience) and overall energy of 1, the merged signal would have two ratio parameters 0.25 and 0.5, respectively, which determine the proportions of the first and second signal at the merged signal with respect to the merged overall energy, which is 2 in this case (assuming incoherence between the merged signals). At the merged signal the remainder, i.e., 0.25 of the overall energy, is ambience. In such an example, two signals each with a single set of directional/energetic parameters are merged into one signal with two sets of directional/energetic parameters. Although a static example was detailed, all or most described parameters typically vary over time and frequency.

The determined direction(s) and energy ratio(s) may be output to a metadata processor 161. In some embodiments other spatial or directional parameters or alternative expressions of the same information may be determined by the metadata generator. For example ambience information, in other words non-directional information associated with the at least one audio signal, may be determined by the metadata generator and thus be expressed as an ambience parameter.

Although the example in FIG. 1 shows the determination of N energy ratios and 1 overall energy value, and the values being used to in the merging process (and furthermore the energy ratios being used as metadata parameters) the same information may be signalled in other ways. For example by determining N absolute energy parameters. In other words the information associated with the energy of the audio signals and the energy associated with the directions may be represented in any suitable manner.

The system shown in FIG. 1 may further comprise an audio and metadata generator 151. The audio and metadata generator 151 may be configured to generate combined audio signals and metadata information.

The spatial audio capture device 141 may be configured to output the spatial audio signals to the audio and meta-data generator 151. Furthermore the spatial audio capture device 141 may be configured to output the associated metadata to the audio and meta-data generator 151. The output may be wireless transmission according to any suitable wireless transmission protocol.

In some embodiments the audio and metadata generator 151 is configured to receive the spatial audio signals and associated metadata from the SPAC device 141. The audio and metadata generator 151 may furthermore be configured to receive at least one audio object signal. The at least one audio object signal may be from an external microphone 181. The external microphone may be an example of a 'close' audio source capture apparatus and may in some embodiments be a boom microphone or similar 'neighbouring' or close microphone capture system. The following examples are described with respect to a Lavalier microphone and thus feature a Lavalier audio signal. However some examples may be extended to any type of microphone external or separate to the SPAC device array of microphones. The following methods may be applicable to any external/additional microphones be they Lavalier microphones, hand held microphones, mounted microphones, or whatever. The external microphones can be worn/carried by persons or mounted as close-up microphones for instruments or a microphone in some relevant location which the designer wishes to capture accurately. The external microphone may in some embodiments be a microphone array. The external microphone typically comprises a small microphone on a lanyard or a microphone otherwise close to the mouth. For other sound sources, such as musical instruments, the audio signal may be provided either by a Lavalier microphone or by an internal microphone system of the instrument (e.g., pick-up microphones in the case of an electric guitar).

In some embodiments the audio and metadata generator 151 comprises an energy/direction analyser 157. The energy/direction analyser 157 may be configured to analyse frequency-band signals. The energy/direction analyser 157 may be configured to receive the at least one audio object signal and determine an energy parameter value associated with the at least one audio object signal. The energy parameter value may then be passed to a metadata processor 161. The energy/direction analyser 157 may be configured to determine a direction parameter value associated with the at least one audio object signal. The direction parameter value may then be passed to the metadata processor 161.

In some embodiments the audio and metadata generator 151 comprises a metadata processor 161. The metadata processor 161 may be configured to receive the metadata associated with the SPAC device audio signal and furthermore the metadata associated with the audio object signal. The metadata processor 161 may thus receive, for example from the metadata generator 147, the directional parameters such as the identified SPAC (modelled audio source) direction per time-frequency instance and the energy parameters such as the N identified SPAC direction (modelled audio source) energy ratios. The metadata processor 161 may furthermore receive from the energy/direction analyser 157 the audio object signal energy parameter value(s) and the audio object directional parameters. From these inputs the metadata processor 161 may be configured to generate a suitable combined parameter (or metadata) output which includes the SPAC and the audio object parameter information. Thus for example where the SPAC device metadata comprises 1 direction and 1 energy ratio parameter (and 1 overall energy parameter for the merging process) and the audio object (external microphone) metadata comprises 1 direction parameter (and 1 overall energy parameter for the merging process), the output metadata may comprise 2 directions where the audio object signal direction is treated as an additional identified direction. Furthermore in some embodiments the output metadata may comprise 2 energy (such as the energy ratio) parameters, which may be the ratio of the power in the SPAC device direction relative to the total energy of the merged audio signals and the other may be the ratio of the audio object audio signal relative to the total energy of the merged audio signals. In other words a processor may be configured to generate a combined parameter output based on the at least one parameter associated with the audio signal from the external microphone with at least one parameter associated with the spatial capture audio signal. The metadata may then be output to be stored or to be used by the audio renderer. The overall energy parameters of the object audio signal and the SPAC device audio signal are applied in determining the merged signal relative energy parameters. The combined overall energy may be included to the output metadata, although in typical use cases it may not be necessary to store or transmit this parameter after the merging. In some embodiments the energy parameters may be passed to the object inserter 163 as shown by the dashed line. This information may be passed between the metadata processor and the object inserter in the other embodiments described hereafter. For example, the object inserter may perform adaptive equalization of the output signal based on the energy parameters and any other parameters. Such a process may be necessary for example if the signals to be merged have mutual coherence but are not temporally aligned.

In some embodiments of the audio and metadata signal generator 151 comprises an object inserter 163. The object inserter 163 or mixer or audio signal combiner may be configured to receive the microphone array 145 audio signals and the audio object signal. The object inserter 163 may then be configured to combine the audio signals from the microphone array 145 with the audio object signal. The object inserter or mixer may thus be configured to combine the at least one audio signal (originating from the spatial capture device) with the audio object signal to generate a combined audio signal with a same number or fewer number of channels as the at least one audio signal.

The object inserter or mixer may generate a combined audio signal output where the audio object signal is treated as an added audio source (or object). The object inserter or mixer may generate the combined audio signal by combining the external microphone audio signal with one or more of the microphone array audio signals and where the other microphone array audio signals are not modified. For example where there is one audio object (external microphone) audio signal and M SPAC device microphone array audio signals to be combined the mixer may combine only one of the M SPAC device audio signals with the audio object audio signal.

The combined at least one audio signals may then be output. For example the audio signals may be stored for later processing or passed to the audio renderer.

Where the audio source signal is coherent but temporally non-aligned with respect to the spatial audio capture device signals to which they are mixed an alignment operation may be performed to match the time and/or phase of the in-mixed signal prior to the addition process. This may for example be achieved by delaying the microphone array signals. The delay may be negative or positive and be determined according to any suitable technique. An adaptive equalizer, such as adaptive gains in frequency bands, may also be applied to ensure that any unwanted spectral effects of the additive process can be mitigated, such as those due to in-phase or out-of-phase addition of the coherent signals.

In such a manner the metadata may be expanded with a second simultaneous direction of the in-mixed audio-object signal. The energy-ratio parameters within the SPAC metadata are processed to account for the added energy of the audio-object signal.

Although the example above describes the SPAC metadata related to the microphone-array signals having one direction at each time-frequency instance other examples may have more than one direction at each time-frequency instance. Similarly although the above describes a process for merging one audio object signal (and its associated metadata) with the SPAC audio signal and associated metadata other examples may merge more than one audio object signal (and associated metadata).

Furthermore although the example shown above shows the SPAC device comprising the metadata generator 147 configured to generate the directional metadata associated with the microphone array 145 audio signal(s) the generation of the metadata or spatial analysis may be performed within the audio and metadata generator 151. In other words the audio and metadata generator 151 may comprise a spatial analyser configured to receive the SPAC device microphone array output and generate the directional and energy parameters.

Similarly although the example shown above shows the audio and metadata generator comprising the energy/direction analyser 157 configured to generate metadata associated with the audio object signal in some further examples the audio and metadata generator is configured to receive the metadata associated with the audio object signal.

Figure 2:
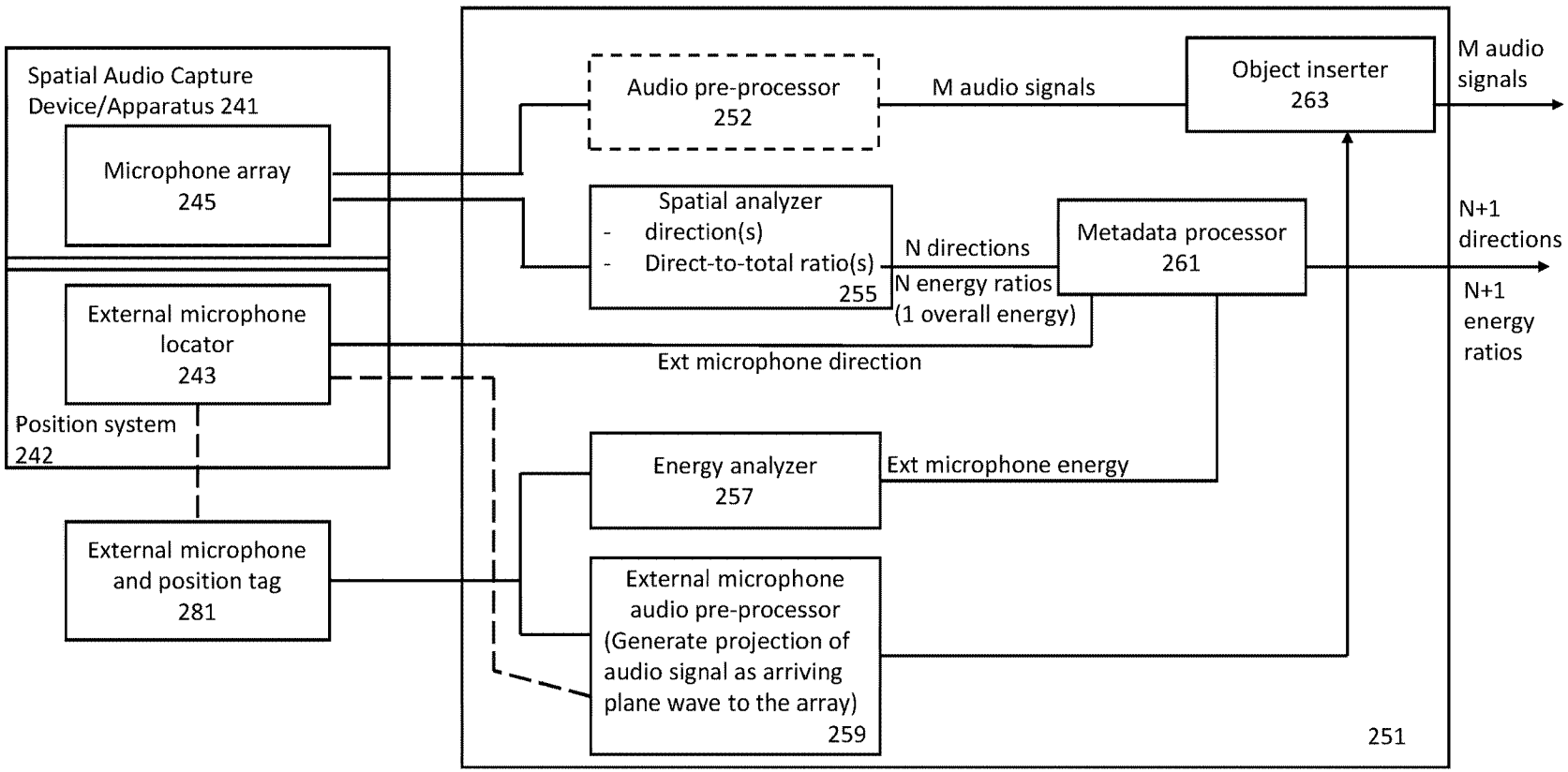

With respect to FIG. 2 a second embodiment is shown in the context of spatial audio recording. In the example shown in FIG. 2 spatial sound is recorded with a presence capture device having a microphone array, and one or more sources within the sound scene are equipped with close microphones and a position-tracking device, which provides the information of the position of the sources with respect to the presence-capture device. The close-microphone signals are processed to be a part of the microphone-array signals, and the SPAC metadata is expanded with as many new directions as there are added close-microphone signals. The directional information is retrieved from the data from the position-tracking system. The SPAC energetic parameters are processed to reflect the relative amounts of the sound energy of each input audio signal type. This second embodiment mainly intended for use cases, where the prominence, clarity, or intelligibility of certain sources, such as actors, are enhanced.

The example system of apparatus for implementing such an embodiment is shown in FIG. 2. In this example the system may comprise a spatial audio capture (SPAC) device 241, for example an omni-directional content capture (OCC) device. The spatial audio capture device 241 may comprise a microphone array 245. The microphone array 245 may be any suitable microphone array for capturing spatial audio signals and may be similar or the same as the microphone array 145 shown in FIG. 1.

The at least one audio signal may be associated with spatial metadata. The spatial metadata associated with the at least one audio signal may contain directional information with respect to the SPAC device. The example shown in FIG. 2 shows the metadata being generated by an audio and metadata generator 251 but in some embodiments the SPAC device 241 may comprise a metadata generator configured to generate this metadata from the microphone array in a manner shown in FIG. 1.

The spatial audio capture device 241 may be configured to output the spatial audio signals to the audio and metadata generator 251.

Furthermore as shown in FIG. 2 the system may comprise one or more audio object signal generator. In the example shown in FIG. 2 the at least one audio object signal is represented by an external microphone 281. The external microphone 281 as discussed with respect to FIG. 1 may be any suitable microphone capture system.

The system as shown in FIG. 2 furthermore may comprise a position system 242. The position system 242 may be any suitable apparatus configured to determine the position of the external microphone 281 relative to the SPAC device 241. In the example shown in FIG. 2 the external microphone is equipped with a position tag, a radio frequency signal generator configured to generate a signal which is received by an external microphone locator 143 at the positioning system 242 and from the received radio frequency signal determine the orientation and/or distance between the external microphone 281 and the SPAC device 241. In some embodiments the position system (tags and receiver) are implemented using High Accuracy Indoor Positioning (HAIP) or another suitable indoor positioning technology. In addition to or instead of HAIP, the position system may use video content analysis and/or sound source localization. The positioning can also be performed or adjusted manually using a suitable interface (not shown). This could be necessary for example when the audio signals are generated or recorder at another time or location, or when the position tracking devices are not available. The determined position is passed to the audio and metadata generator 251.

The system such as shown in FIG. 2 may further comprise an audio and metadata generator 251. The audio and metadata generator 251 may be configured to generate combined audio signals and metadata information.

In some embodiments the audio and metadata generator 251 is configured to receive the spatial audio signals from the SPAC device 241.

The audio and metadata generator 251 may comprise a spatial analyser 255. The spatial analyser 255 may receive the output of the microphone array 245 and based on knowledge of the arrangement of the microphones in the microphone array 245 generate the direction metadata described with respect to FIG. 1. The spatial analyser 255 may furthermore generate the parameter metadata in a manner similar to that described with respect to FIG. 1. Thus for example as shown in FIG. 2 the spatial analyser may generate N directions, N energy ratios (each associated with a direction) and 1 overall or total energy. This metadata may be passed to a metadata processor 261.

The audio and metadata generator 251 may furthermore be configured to receive the at least one audio object signal from the external microphone 281.

In some embodiments the audio and metadata generator 251 comprises an energy analyser 257. The energy analyser 257 may receive the audio signal from the external microphone 281 and be similar to the energy/direction analyser 151 discussed with respect to FIG. 1 and determine an energy parameter value associated with the at least one audio signal.

In some embodiments the audio and metadata generator 251 comprises a metadata processor 261. The metadata processor 261 may be configured to receive the metadata associated with the SPAC device audio signal and furthermore the metadata associated with the audio object signal. The metadata processor 261 may thus receive the directional parameters such as the N identified SPAC (modelled audio source) directions per time-frequency instance and the energy parameters such as the N identified SPAC direction (modelled audio source) energy parameters. The metadata processor 261 may furthermore receive from the external microphone locator 243 the audio object directional parameters and the energy parameter from the energy analyser 257. From these inputs the metadata processor 261 may be configured to generate a suitable combined parameter (or metadata) output which includes the SPAC and the audio object parameter information. Thus for example where the SPAC device metadata comprises N directions, N energy ratios, and 1 overall energy parameter and the audio object (external microphone) metadata comprises 1 direction and 1 energy parameter, the output metadata may comprise N+1 directions and N+1 energy ratio parameters where the audio object signal direction is treated as an additional identified direction and the energy (such as the energy ratio) parameters, which may be the ratio of the power in the SPAC device direction relative to the total energy of the merged audio signals and the other may be the ratio of the audio object audio signal relative to the total energy of the merged audio signals. In other words a processor may be configured to generate a combined parameter output based on the at least one parameter associated with the audio signal from the external microphone with at least one parameter associated with the spatial capture audio signal. The metadata may then be output to be stored or to be used by the audio renderer.

In some embodiments the audio and metadata generator 251 comprises an external microphone audio pre-processor. The external microphone audio pre-processor may be configured to receive the at least one audio object signal from the external microphone. Furthermore the external microphone audio pre-processor may be configured to receive the associated direction metadata associated with the audio object signal (or orientation or location) relative to the spatial audio capture apparatus such as provided by the external microphone locator 243 (shown for example in FIG. 2 by the dashed connection between the external microphone audio pre-processor 259 and the output of the external microphone locator 243). The external microphone audio pre-processor may then be configured to generate a suitable audio signal which is passed to the object inserter.

In some embodiments external microphone audio pre-processor may generate an output audio signal based on the direction (and in some embodiments the energy estimate) associated with the external microphone audio object signal. For example the external microphone audio pre-processor may be configured to generate a projection of the audio object (external microphone) audio signal as a plane wave arriving at the microphone array 245. This may for example be presented in the same signal format which is input to the object inserter from the microphone array. In some embodiments the external microphone audio pre-processor may be configured to generate at least one mix audio signal for the object inserter according to one or many options. Furthermore the audio pre-processor may indicate or signal which option has been selected. The indicator or signal may be received by the object inserter 263 or mixer so that the mixer can determine how to mix or combine the audio signals. Furthermore in some embodiments the indicator may be received by a decoder, so that the decoder can determine how to extract the audio signals from each other.

In some embodiments of the audio and metadata signal generator 251 comprises an object inserter 263. The object inserter 263 or mixer or audio signal combiner may be configured to receive the microphone array 245 audio signals and the audio object signal. The object inserter 263 may then be configured to combine the audio signals from the microphone array 245 with the audio object signal. The object inserter 263 or mixer may thus be configured to combine the at least one audio signal (originating from the spatial capture device 241) with the external microphone 281 audio object signal to generate a combined audio signal with a same number or fewer number of channels as the at least one audio signal from the spatial audio capture device 241.

The object inserter or mixer may generate a combined audio signal output in any suitable way.

The combined at least one audio signals may then be output. For example the audio signals may be stored for later processing or passed to the audio renderer.

The audio and metadata generator 251 may comprise an optional audio pre-processor 252 (shown in FIG. 2 by the dashed box). The pre-processing is shown before the SPAC analysis between microphone array 245 and object inserter 263. Although only FIG. 2 shows the audio pre-processor it may be implemented in any of the embodiments shown herein.

The audio pre-processing may include only some of the channels, and be any kind of an audio pre-processing step. The audio pre-processor may receive the output (or part of the output) from the spatial audio capture device microphone array 245 and perform pre-processing on the received audio signals. For example the microphone array 245 may output a number of audio signals which are received by the audio pre-processor which generates M audio signals. The audio pre-processor may be a downmixer converting M' audio signals from the microphone array to a spatial audio format defined by the M audio signals. The audio pre-processor may output the M audio signals to the object inserter 263.

Figure 3:
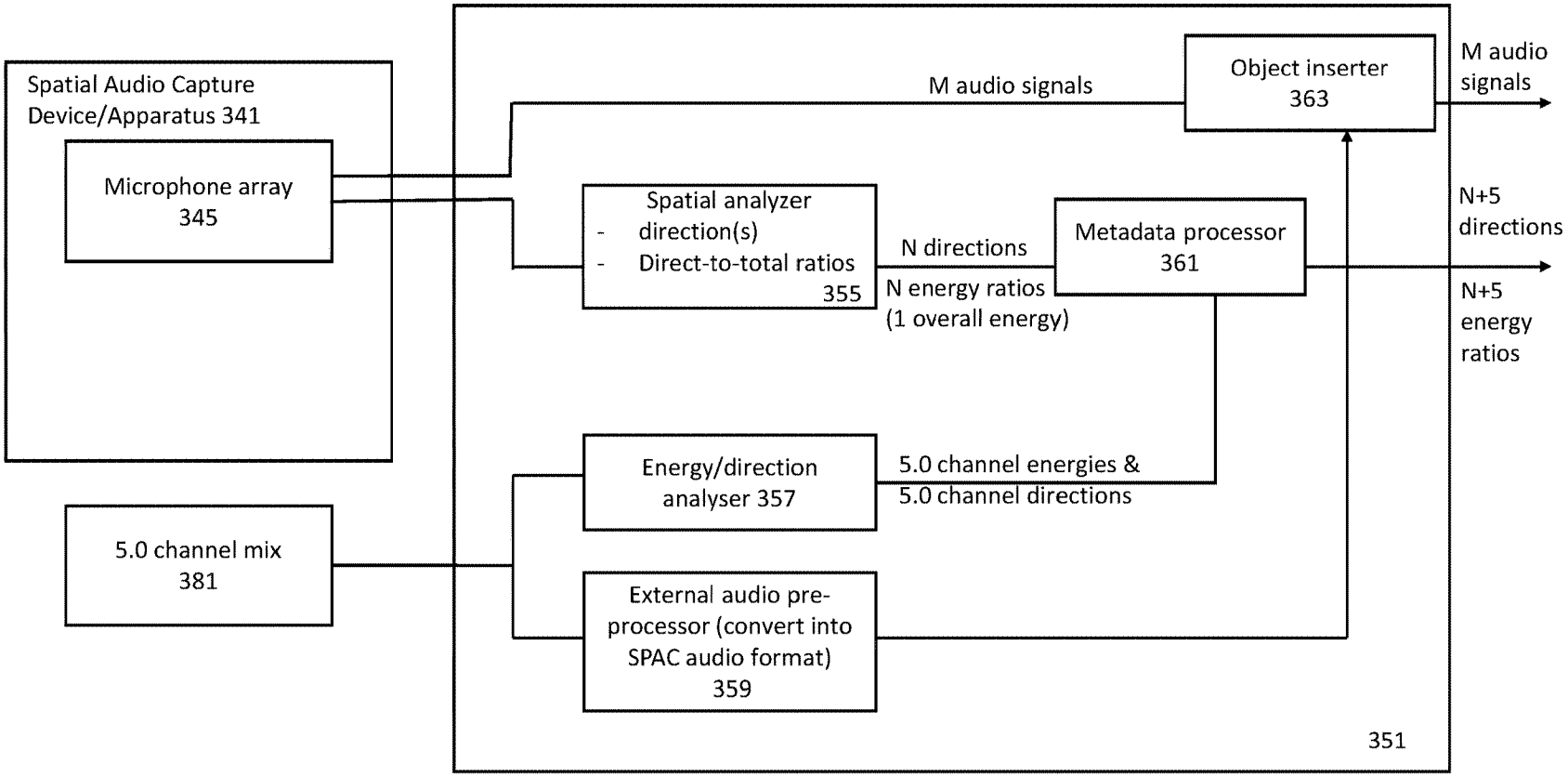

A third embodiment is shown with respect to FIG. 3 where a 5.0-channel loudspeaker mix is merged with SPAC metadata. In this example the system may comprise a spatial audio capture (SPAC) device 341, for example an omni-directional content capture (OCC) device. The spatial audio capture device 341 may comprise a microphone array 345. The microphone array 345 may be any suitable microphone array for capturing spatial audio signals and may be similar or the same as the microphone array shown in FIG. 1 and/or FIG. 2.

The at least one audio signal may be associated with spatial metadata. The spatial metadata associated with the at least one audio signal may contain directional information with respect to the SPAC device. The example shown in FIG. 3 shows the metadata being generated by an audio and metadata generator 351 in a manner similar to FIG. 2 but in some embodiments the SPAC device 341 may comprise a metadata generator configured to generate this metadata from the microphone array in a manner shown in FIG. 1.

The spatial audio capture device 341 may be configured to output the spatial audio signals to the audio and metadata generator 351.

Furthermore as shown in FIG. 3 the system may comprise one (or more) 5.0 channel mix (comparable to a set of audio objects) 381. In some embodiments the audio object may be any suitable multichannel audio mix.

The system as shown in FIG. 3 may further comprise an audio and metadata generator 351. The audio and metadata generator 351 may be configured to generate combined audio signals and metadata information.

In some embodiments the audio and metadata generator 351 is configured to receive the spatial audio signals from the SPAC device 341.

The audio and metadata generator 351 may comprise a spatial analyser 355. The spatial analyser 355 may receive the output of the microphone array 345 and based on knowledge of the arrangement of the microphones in the microphone array 345 generate the direction metadata described with respect to FIG. 1 and/or FIG. 2. The spatial analyser 355 may furthermore generate the parameter metadata in a manner similar to that described with respect to FIG. 2. This metadata may be passed to a metadata processor 361.

The audio and metadata generator 351 may furthermore be configured to receive the 5.0 channel mix 381.

In some embodiments the audio and metadata generator 351 comprises an energy/direction analyser 357. The energy/direction analyser 357 may be similar to the energy analyser 251 discussed with respect to FIG. 2 and determine energy parameter values associated with each channel of the 5.0 channel mix. Furthermore the energy/direction analyser 357 may be configured to generate 5.0 mix directions based on the known distribution of channels. For example in some embodiments the 5.0 mix is arranged 'around' the SPAC device and as such the channels are arranged at the standard 5.0 channel directions around a listener.

In some embodiments the audio and metadata generator 351 comprises a metadata processor 361. The metadata processor 361 may be configured to receive the metadata associated with the SPAC device audio signal and furthermore the metadata associated with the 5.0 channel mix and from these generate a suitable combined parameter (or metadata) output which includes the SPAC and the 5.0 channel mix object parameter information. Thus for example where the SPAC device metadata comprises 1 direction, 1 energy ratio and 1 overall energy parameter value and the 5.0 channel mix metadata comprises 5 direction and 5 energy parameter values, the output metadata may comprise 6 directions and 6 energy parameters.

In some embodiments the audio and metadata generator 351 comprises an external audio pre-processor 359. The external audio pre-processor may be configured to receive the 5.0 channel mix. Furthermore the external microphone audio pre-processor may be configured to receive the associated direction metadata associated with the 5.0 channel mix. The audio pre-processor may then be configured to generate a suitable audio signal which is passed to the object inserter.

In some embodiments of the audio and metadata signal generator 351 comprises an object inserter 363. The object inserter 363 or mixer or audio signal combiner may be configured to receive the microphone array 345 audio signals and the converted 5.0 channel mix. The object inserter 363 may then be configured to combine the audio signals to generate a combined audio signal with a same number or fewer number of channels as the at least one audio signal.

Figure 4:
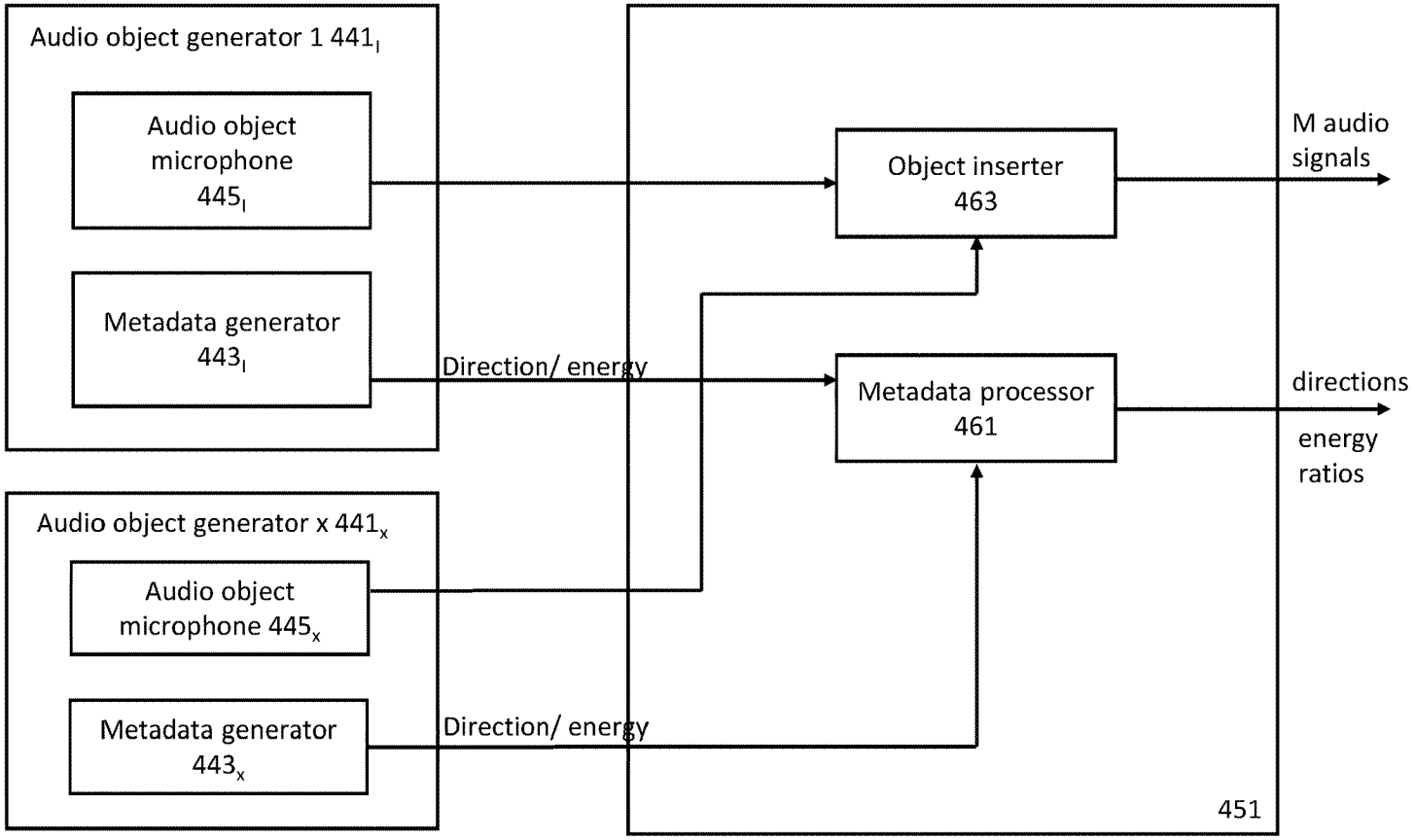

A fourth embodiment is shown with respect to FIG. 4 where SPAC-metadata and corresponding audio signals is formulated based on only a set of audio-object and/or loudspeaker channel signals, which is a process saving bit rate due to the reduction of the transmitted channels.

In this example the system may comprise a first audio object generator (audio object generator 1) $\mathbf{441}_1$ which may in some embodiments comprise a spatial audio capture (SPAC) device modelled as an audio object microphone

445$_1$ and a metadata generator 443$_1$. The audio object microphone 445$_1$ may be configured to output an audio signal to an audio and metadata generator 451. Furthermore the metadata generator 443$_1$ may output spatial metadata associated with the audio signal to the audio and metadata generator 451 in a manner similar to FIG. 1.

The system may comprise second audio object generators (shown in FIG. 4 by audio object generator x) 441$_x$ which may in some embodiments comprise a spatial audio capture (SPAC) device modelled as an audio object microphone 445$_x$ and a metadata generator 443$_x$. The audio object microphone 445$_x$ may be configured to output an audio signal to the audio and metadata generator 451. Furthermore the metadata generator 443$_x$ may also output spatial metadata associated with the audio signal to the audio and metadata generator 451.

In some embodiments the audio object may be any suitable single or multichannel audio mix or loudspeaker mix, or an external microphone signal in a manner similar to FIG. 1 or FIG. 2.

The system as shown in FIG. 4 may further comprise an audio and metadata generator 451. The audio and metadata generator 451 may be configured to generate combined audio signals and metadata information. The audio and metadata generator 451 is configured to receive the audio object signals and the associated metadata from the generators 441.

In some embodiments the audio and metadata generator 451 comprises a metadata processor 461. The metadata processor 461 may be configured to receive the metadata associated with the audio object generator audio signals and from these generate a suitable combined parameter (or metadata) output which includes the object parameter information.

In some embodiments of the audio and metadata signal generator 451 comprises an object inserter 463. The object inserter 463 or mixer or audio signal combiner may be configured to receive the audio signals and combine the audio signals to generate a combined audio signal.

Figure 5:
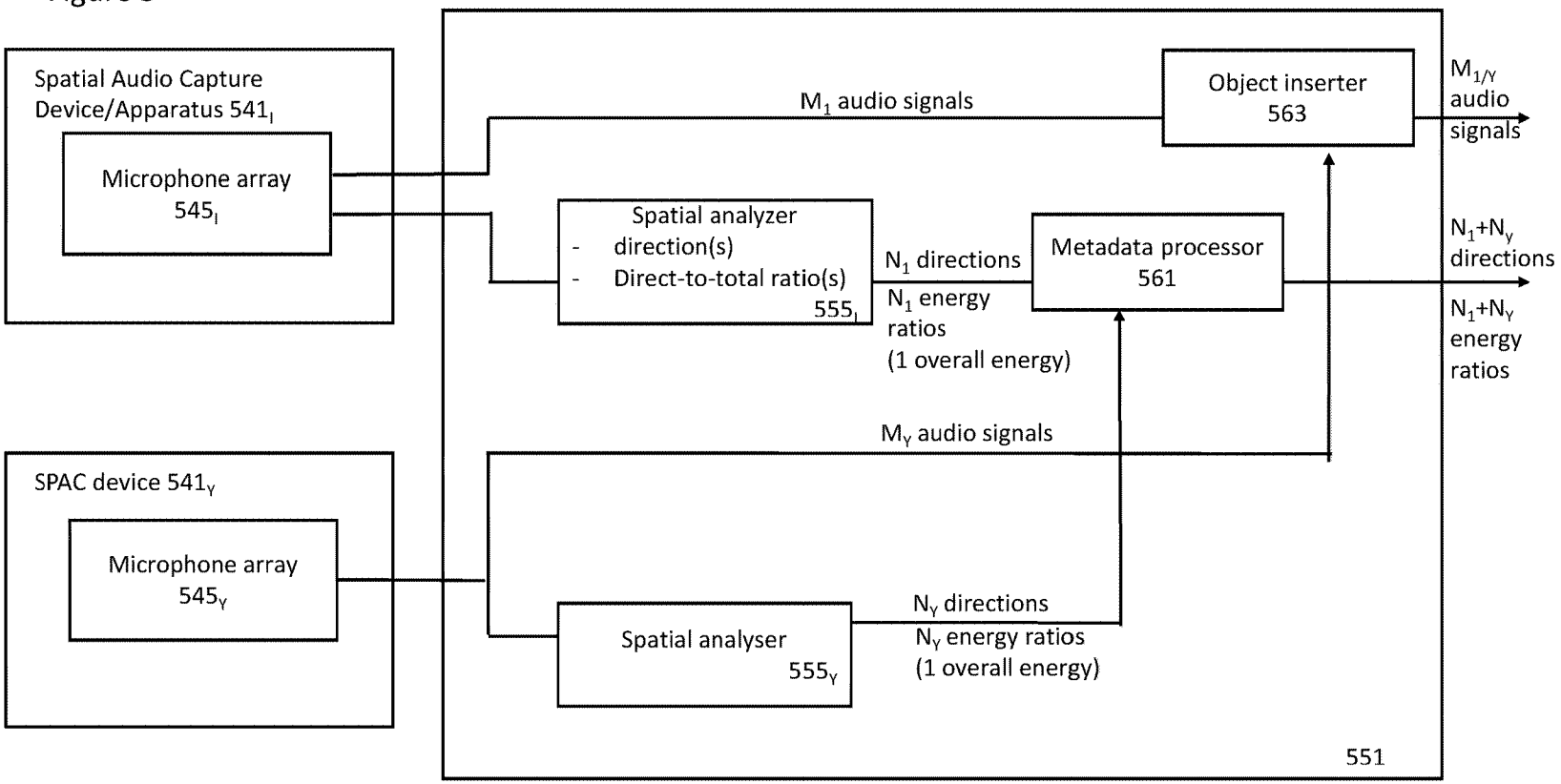

With respect to FIG. 5 a fifth embodiment is described where two SPAC streams are merged to produce one merged SPAC stream with the combined metadata. In this example the system may comprise a first spatial audio capture (SPAC) device 541$_1$. The first spatial audio capture device 541$_1$ may comprise a microphone array 545$_1$. The microphone array 545$_1$ may be any suitable microphone array for capturing spatial audio signals and may be similar or the same as the microphone array shown earlier. The at least one audio signal may be associated with spatial metadata. The spatial metadata associated with the at least one audio signal may contain directional information with respect to the SPAC device. The first spatial audio capture device 541$_1$ may be configured to output the spatial audio signals to the audio and metadata generator 551.

Furthermore as shown in FIG. 5 the system may comprise one (or more) further spatial audio capture (SPAC) device 541$_Y$. The further (y'th) spatial audio capture device 541$_Y$ may comprise a microphone array 545$_Y$. The microphone array 545*Y* may be the same as or different from the microphone array 545$_1$ associated with the first SPAC device 541$_1$. The further spatial audio capture device 541$_1$ may be configured to output the spatial audio signals to the audio and metadata generator 551.

The example shown in FIG. 5 shows the metadata being generated by an audio and metadata generator 551 but in some embodiments the SPAC devices 541 may comprise a metadata generator configured to generate this metadata from the microphone array in a manner shown in FIG. 1.

The system as shown in FIG. 5 may further comprise an audio and metadata generator 551. The audio and metadata generator 551 may be configured to generate combined audio signals and metadata information.

In some embodiments the audio and metadata generator 551 is configured to receive the spatial audio signals from the SPAC devices 541.

The audio and metadata generator 551 may comprise a one or more spatial analysers 555. In the example shown in FIG. 5 each SPAC device is associated with a spatial analyser 555 configured to receive the output of the microphone array 545 and based on knowledge of the arrangement of the microphones in the microphone array 545 generate the direction metadata described with respect to FIG. 1 and/or FIG. 2. The spatial analyser 555 may furthermore generate the parameter metadata in a manner similar to that described with respect to FIG. 2. This metadata may be passed to a metadata processor 561.

In some embodiments the audio and metadata generator 551 comprises a metadata processor 561. The metadata processor 561 may be configured to receive the metadata associated with the SPAC device audio signals and from these generate a suitable combined parameter (or metadata) output which includes all the SPAC parameter information. Thus for example where the first SPAC device metadata comprises $N_1$ direction and $N_1$ energy parameter values (and 1 overall energy parameter value) and the first SPAC device metadata comprises $N_Y$ direction and $N_Y$ energy parameter values (and 1 overall energy parameter value), the output metadata may comprise $N_1+N_Y$ directions and $N_1+N_Y$ energy parameters.

In some embodiments of the audio and metadata signal generator 551 comprises an object inserter 563. The object inserter 563 or mixer or audio signal combiner may be configured to receive the microphone array 545$_1$ audio signals and the microphone array 545$_Y$ audio signals. The object inserter 563 may then be configured to combine the audio signals to generate a combined audio signal with a same number or fewer number of channels as either the number of channels from the microphone array 545$_1$ audio signals or the microphone array 545$_Y$.

Figure 6:
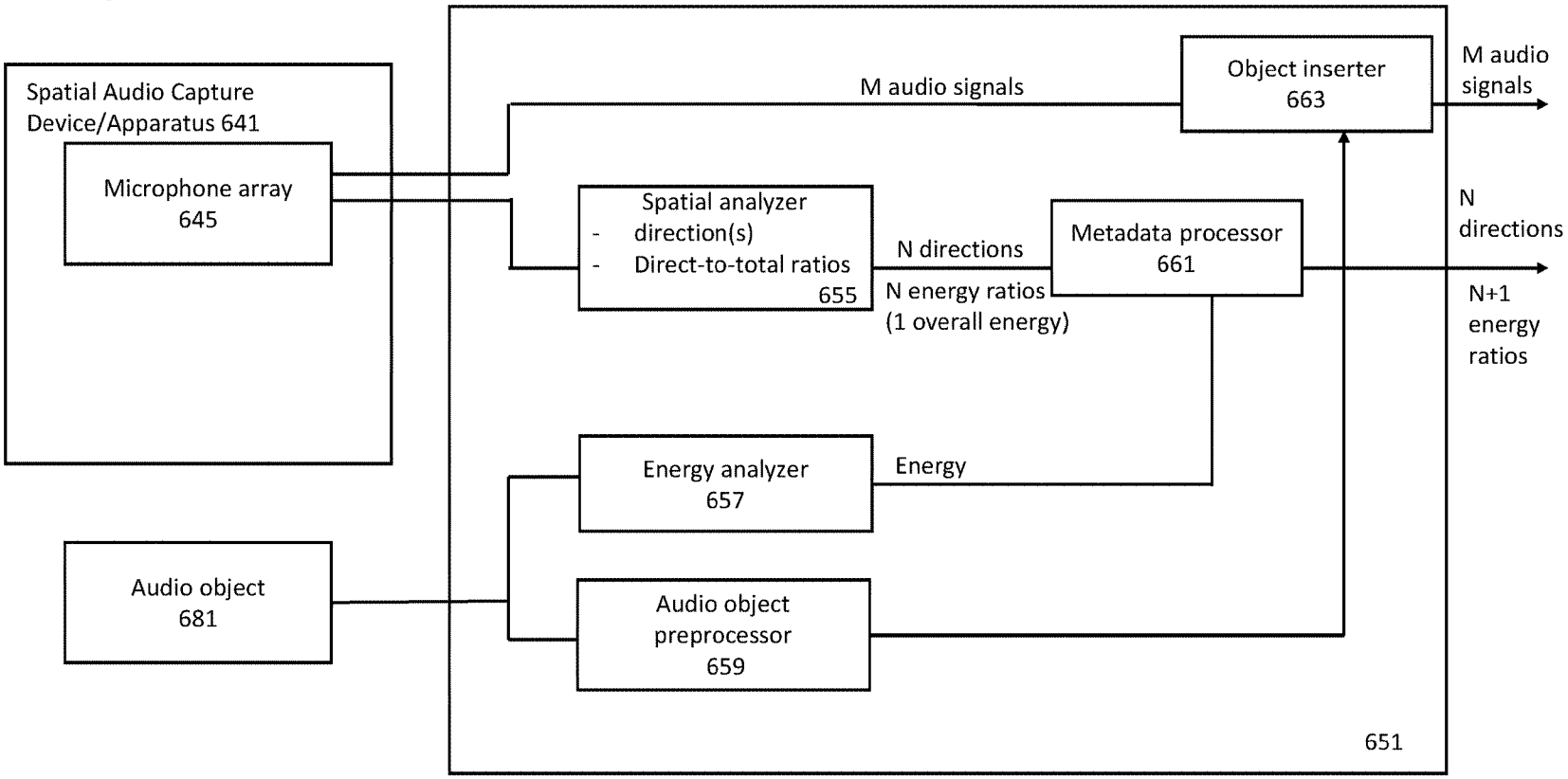

The example shown in FIG. 6 shows a sixth embodiment in which the in-mixed audio-object signal is defined to be a signal type that is not spatialized in the sound scene. In other words it is intended to be reproduced without HRTF processing. Such a signal type is required for artistic use, for example, reproducing a commentator track inside the listener's head instead of being spatialized within the sound scene.

In this example the system may comprise a spatial audio capture (SPAC) device 641 which comprises a microphone array 645 similar or the same as any previously described microphone array. The at least one audio signal may be associated with spatial metadata containing directional information with respect to the SPAC device. The example shown in FIG. 6 shows the metadata being generated by an audio and metadata generator 651. The spatial audio capture device 641 may be configured to output the spatial audio signals to the audio and metadata generator 651.

Furthermore as shown in FIG. 6 the system may comprise one or more audio object signal generator 681.

The system such as shown in FIG. 6 may further comprise an audio and metadata generator 651. The audio and metadata generator 651 may be configured to generate combined audio signals and metadata information.

In some embodiments the audio and metadata generator 651 is configured to receive the spatial audio signals from the SPAC device 641.

The audio and metadata generator 651 may comprise a spatial analyser 655. The spatial analyser 655 may receive the output of the microphone array 645 and based on knowledge of the arrangement of the microphones in the microphone array 645 generate the direction metadata described with respect to FIG. 1. The spatial analyser 655 may furthermore generate the energy parameter metadata in a manner similar to that described with respect to FIG. 1. This metadata may be passed to a metadata processor 661.

The audio and metadata generator 651 may furthermore be configured to receive the at least one audio object signal from the audio object 681.

In some embodiments the audio and metadata generator 651 comprises an energy analyser 657. The energy analyser 657 may be similar to the energy/direction analyser 651 discussed with respect to FIG. 1 and determine an energy parameter value associated with the at least one audio object signal.

In some embodiments the audio and metadata generator 651 comprises a metadata processor 661. The metadata processor 661 may be configured to receive the metadata associated with the SPAC device audio signal and furthermore the metadata associated with the audio object signal. The metadata processor 661 may thus receive the directional parameters such as the identified SPAC (modelled audio source) direction per time-frequency instance and the energy parameters such as the N identified SPAC direction (modelled audio source) energy parameters. From these inputs the metadata processor 661 may be configured to generate a suitable combined parameter (or metadata) output which includes the SPAC and the audio object parameter information. Thus for example where the SPAC device metadata comprises 1 direction and at least 1 energy parameter and the audio object (external microphone) metadata comprises 1 energy parameter, the output metadata may comprise 1 direction and 2 energy parameters (such as 2 energy ratio parameters). In some embodiments the metadata processor may furthermore determine whether the audio object (or in some cases the actual spatial audio capture device) audio signals is to be spatially processed by the decoder (or receiver or renderer). In such embodiments the metadata processor may generate an indicator to be added to the metadata output to indicate the result of the determination. For example in the example shown in FIG. 6 the metadata processor 661 may generate a flag value or indicator value that indicates to the decoder that the audio object is 'non-spatial'. However this indicator or flag value may be generated in any embodiment implementation and define a 'spatial' mode associated with the audio signal. For example an audio object such as shown in FIG. 1 may be determined to be "spatial-head-tracked" and an associated flag or indicator value generated which causes the decoder to spatially process the audio object signal based on a head-tracker or other similar user interface input. Furthermore the audio object may be determined to be "spatial-non-head-tracked", and an associated flag or indicator value generated which causes the decoder to spatially process the audio object signal but not enable the spatial processing to be based on a head-tracker or other similar user interface input. A third type as discussed above is a "non-spatial" audio object wherein there is no spatial processing (such as HRTF processing) of the audio signal associated with the audio object and an associated flag or indicator value generated which causes the decoder to display the audio object signal using for example a lateralization or amplitude panning operation. A SPAC device parameter stream may thus generate/store and transmit an "other parameter" that indicates the signal type, and any related information.

In some embodiments the audio and metadata generator 651 comprises an audio object pre-processor 659. The external microphone audio pre-processor may be configured to receive the at least one audio object signal and generate a suitable audio signal which is passed to the object inserter.

In some embodiments the audio and metadata signal generator 651 comprises an object inserter 663. The object inserter 663 or mixer or audio signal combiner may be configured to receive the microphone array 645 audio signals and the audio object signal. The object inserter 663 may then be configured to combine the audio signals from the microphone array 645 with the pre-processed audio object signal. The object inserter or mixer may thus be configured to combine the at least one audio signal (originating from the spatial capture device) with the external microphone audio object signal to generate a combined audio signal with a same number or fewer number of channels as the at least one audio signal.

Figure 7:
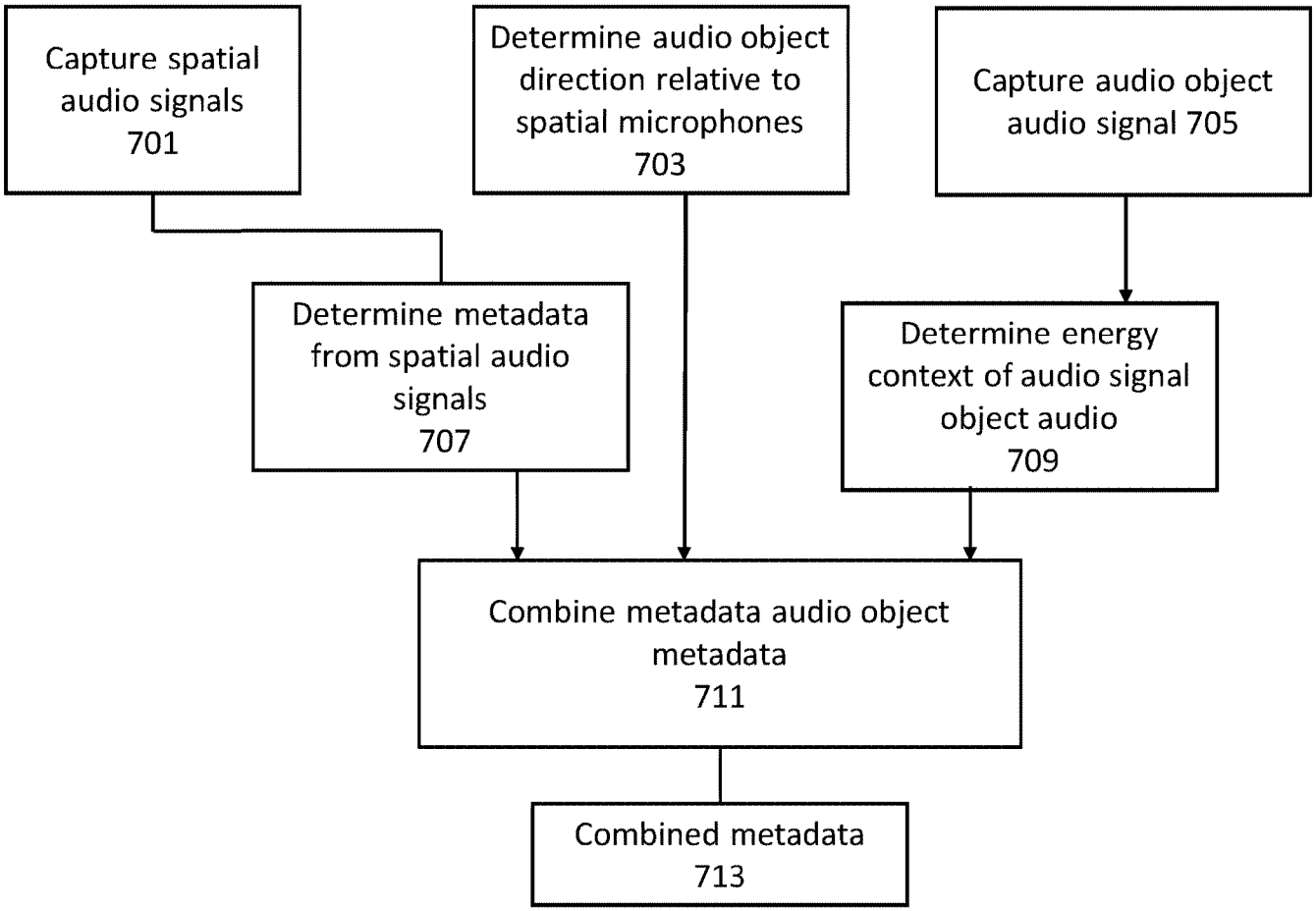
FIGS. 7 and 8 show flow diagrams showing the operation of the example apparatus according to some embodiments.

With respect to FIG. 7 a flow diagram shows example operations of the apparatus shown with regards to the generation of the metadata according to some embodiments.

A first operation is one of capturing the spatial audio signals. For example the microphone array may be configured to generate the spatial audio signals (or in other words capturing the spatial audio signals).

The operation of the capturing at the spatial audio signals is shown in FIG. 7 by step 701.

Furthermore the capture apparatus, and for example an external microphone locator, may further determine the direction (or locations or positions) of any audio objects (external microphones). This location may for example be relative to the spatial microphone array.

The operation of determining the direction of at least one external microphone (relative to the spatial audio capture apparatus and the microphone array) is shown in FIG. 7 by step 703.

The external microphone or similar means may furthermore capture an external microphone audio signal.

The operation of capturing at least one external microphone audio signal is shown in FIG. 7 by step 705.

Having captured the spatial audio signals the method may comprise determining the spatial audio signals in order to determine SPAC device related metadata. For example in some embodiments the determining of spatial metadata may comprise identifying associated direction (or location or position) and energy parameter of the audio signals from the microphone array. Thus for example the directions and parameters of the direct-to-total energy, and total energy can be determined from the spatial audio signals.

The operation of determining the metadata from the spatial audio signals is shown in FIG. 7 by step 707.

Furthermore having captured the external microphone audio signals the method may comprise determining the energy content of the external microphone audio signals.

The operation of determining the energy content of the external microphone audio signal is shown in FIG. 7 by step 709.

The method may further comprise expanding the determined spatial metadata (the information associated with the spatial audio signals) and then reformulating a new metadata output to include the metadata associated with the external microphone audio signal. This may for example involve introducing the external microphone audio signal information as a 'further' or 'physical' audio source or object with a direction determined by the external microphone audio signal and an energy parameter defined by the energy value of the external microphone audio signal.

The operation of expanding the metadata and reformulating the metadata with the external microphone information is shown in FIG. 7 by step 711.

The method may then comprise outputting the expanded/reformulated metadata.

The operation of outputting the expanded/reformatted metadata is shown in FIG. 7 by step 713.

Figure 8:
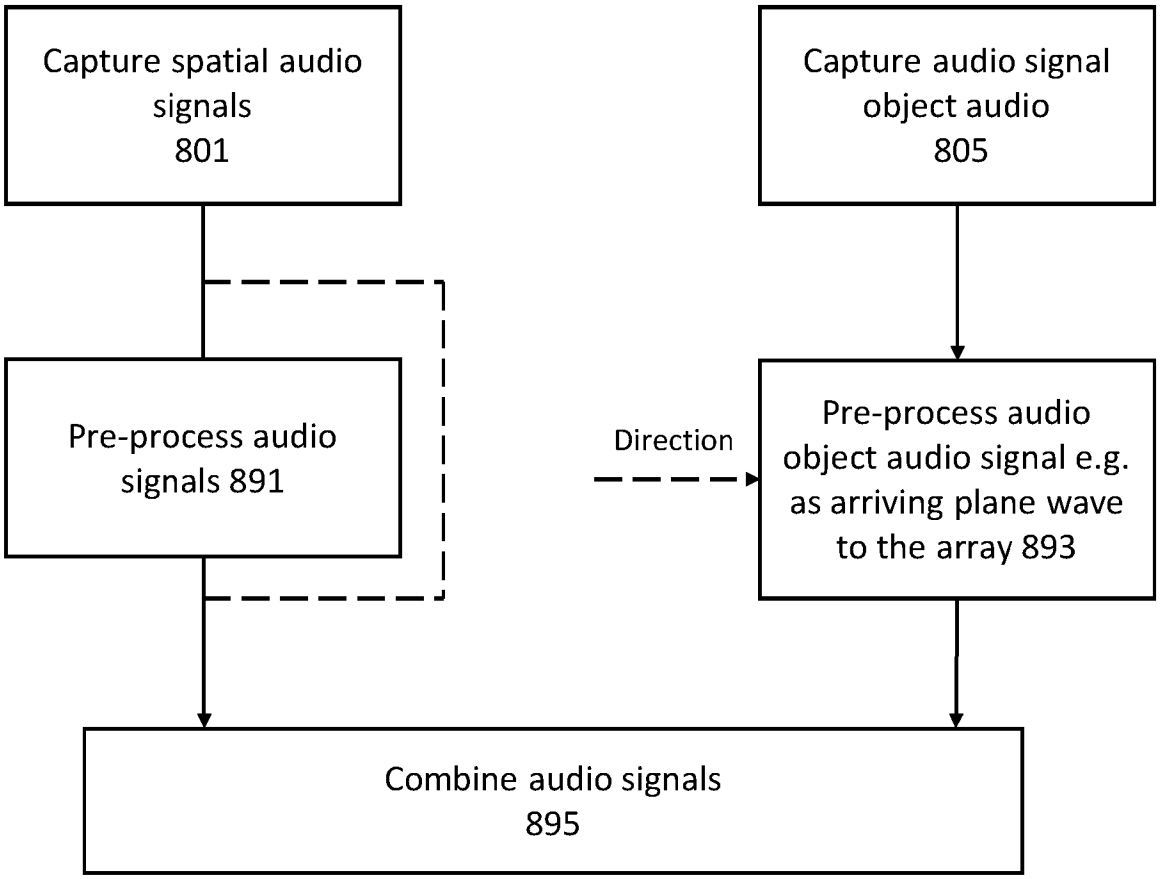

With respect to FIG. 8 a flow diagram shows example operations with regards to the generation of the audio signals according to some embodiments.

A first operation is one of capturing the spatial audio signals. For example the microphone array may be configured to generate the spatial audio signals (or in other words capturing the spatial audio signals).

The operation of the capturing at the spatial audio signals is shown in FIG. 8 by step 801.

The external microphone or similar means may furthermore capture an audio object (such as an external microphone) audio signal.

The operation of capturing at least one external microphone audio signal is shown in FIG. 8 by step 805.

Having captured the spatial audio signals in some embodiments the method comprises the operation of pre-processing the spatial audio signals (such as received from the spatial audio capture apparatus).

The operation of pre-processing the spatial audio signals is shown in FIG. 8 by step 891.

It is understood that this pre-processing operation may be an optional operation (in other words in some embodiments the spatial audio signals are not pre-processed and pass directly to operation 893 as described herein and shown in FIG. 8 by the dashed bypass line.

Having captured the external microphone audio signal the method may comprise pre-processing the external microphone audio signal. In some embodiments this pre-processing is based on the direction information of the external microphone relative to the spatial audio capture apparatus. Thus in some embodiments the pre-processing may comprise generating a plane wave projection of the external microphone audio signal arriving at the array of microphones in the spatial audio capture apparatus.

The operation of pre-processing the external microphone audio signal is shown in FIG. 8 by step 893.

Having pre-processed the external microphone audio signal (and furthermore in some embodiments pre-processed the spatial audio signals) the method may further comprise combining the (pre-processed) spatial audio signals and the pre-processed external microphone audio signals by combining the audio signals.

The operation of combining the audio signals is shown in FIG. 8 by step 895.

Then the combined audio signal may be output.

In some of the examples described herein both the audio object and the spatial captured audio signals may be 'live' and are captured at the same time. However similar methods to those described herein may be applied to any mixing or combination of suitable audio signals. For example similar methods may be applied to where an audio-object is a previously captured, stored (or synthesized) audio signal with a direction and which is to be mixed or combined with a 'live' spatial audio signal. Furthermore similar methods may be applied to a 'live' audio-object with which is mixed with a previously recorded (or stored or synthesized) spatial signal. Also similar methods may be applied to a previously captured, stored (or synthesized) audio-object signal with a direction and which is mixed or combined with a previously captured, stored (or synthesized) spatial audio signal.

A potential use of such embodiments and methods as described herein may be to implement the mixing or merging as an encoding apparatus or method. Furthermore even where there are no microphone array audio signals but only audio objects and loudspeaker channels it would be possible to use the methods described herein to merge the audio channels and generate the parameters such as the SPAC metadata described herein and require fewer transmit channels or storage capacity. The use with respect to loudspeaker channels is because a conventional loudspeaker channel audio signal may be understood to be an object signal with fixed positional information.

Furthermore in the following examples the apparatus is shown as part of an audio capture apparatus and/or audio processing system. However it would be appreciated that in some embodiments the apparatus may be part of any suitable electronic device or apparatus configured to capture an audio signal or receive the audio signals and other information signals. For example embodiments may be implemented with a mobile device such as smartphone, tablet, laptop etc.

The examples as described herein may be considered to be enhancement to conventional Spatial Audio Capture (SPAC) technology.

The examples may furthermore be implemented by methods and apparatus configured to combine microphone (or more generally an audio object) signals with the spatial microphone-array originating signals (or other spatially configured audio signals) while modifying the spatial metadata (associated with the spatial microphone array originating signals). The procedure allows transmission of both signals in the same audio signal, which has a lesser number of channels than the original signals had combined. The modification of the spatial metadata means that the spatial information related to the merged signals are combined to a single set of spatial metadata, enabling that the overall spatial reproduction at the receiver end remains very accurate. As is described herein, this property is achieved by the expansion of the spatial metadata as in particular allowed by the present VR/AR audio format.

In the embodiments as discussed in detail herein the spatial parametric analysis of the microphone-array-originating signals is performed before in-mixing the additional (e.g., external microphone or object) signals. Furthermore as discussed hereafter after in-mixing the object/channel signals the parametric metadata as part of the microphone-array-originating signals is expanded with added directional parameters describing the spatial and energetic properties of the in-mixed signal. This is performed while the existing directional parameters are preserved. In the examples described herein "Preserving directional parameters" means that the original spatial analysis directions are not altered, and the energetic ratio parameters are adjusted such that the amount of the new added signal energy to the total sound energy is accounted for. As is known in many fields of parametric audio processing, it is acknowledged that all these parameters can also be altered for example for artistic purposes, or for example for audio focus use cases, where some spatial directions are emphasized by modifying and adapting the spatial metadata.

In the examples described herein the audio signal may be rendered into a suitable binaural form, where the spatial sensation may be created using rendering such as by head-related-transfer-function (HRTF) filtering a suitable audio signal. A renderer for rendering the audio signal into a suitable form as described herein may be a set of headphones with a motion tracker, and software capable of mixing/binaural audio rendering. With head tracking, the spatial audio can be rendered in a fixed orientation with regards to the earth, instead of rotating along with the person's head. However, it is acknowledged that a part or all of the signals may be, for artistic purposes nevertheless, rendered rotating along the person's head, or reproduced without binaural rendering. Examples of such artistic purposes include reproducing 5.1 background music without head tracking binaurally, or reproducing stereo background music directly to the left and right channels of the headphones, or reproducing a commentator track coherently at both channels. These other signal types may be signalled within the SPAC metadata.

Although the capture and render systems may be separate, it is understood that they may be implemented with the same apparatus or may be distributed over a series of physically separate but communication capable apparatus. For example, a presence-capturing device such as an SPAC device or OCC (omni-directional content capture) device may be equipped with an additional interface for receiving location data and external (Lavalier) microphone sources, and could be configured to perform the capture part.

Furthermore it is understood that at least some elements of the following capture and render apparatus may be implemented within a distributed computing system such as known as the 'cloud'. In some embodiments the spatial audio capture device is implemented within a mobile device. The spatial audio capture device is thus configured to capture spatial audio, which, when rendered to a listener, enables the listener to experience the sound field as if they were present in the location of the spatial audio capture device. The audio object (external microphone) in some embodiments is configured to capture high quality close-up audio signals (for example from a key person's voice, or a musical instrument). When mixed to the spatial audio field, the attributes of the key source such as gain, timbre and spatial position may be adjusted in order to provide the listener with, for example, increased engagement and intelligibility.

In some embodiments the audio signals generated by the object inserter may be passed to a render apparatus comprising a head tracker. The head tracker may be any suitable means for generating a positional or rotational input, for example a sensor attached to a set of headphones or integrated to a head-mounted display configured to monitor the orientation of the listener, with respect to a defined or reference orientation and provide a value or input which can be used by the render apparatus. The head tracker may be implemented by at least one gyroscope and/or digital compass.

The render apparatus may receive the combined audio signals and the metadata. The audio renderer may furthermore receive an input from the head tracker and/or other user inputs. The renderer, may be any suitable spatial audio processor and renderer and be configured to process the combined audio signals, for example based on the directional information within the metadata and the head tracker inputs in order to generate a spatial processed audio signal. The spatial processed audio signal can for example be passed to headphones 125. However the output mixed audio signal can be rendered and passed to any other suitable audio system for playback (for example a 5.1 channel audio amplifier).

The audio renderer may be configured to control the azimuth, elevation, and distance of the determined sources or objects within the combined spatial audio signals based on the metadata. Moreover, the user may be allowed to adjust the gain and/or spatial position of any determined source or object based on the output from the head-tracker. Thus the processing/rendering may be dependent on the relative direction (position or orientation) of the external microphone source and the spatial microphones and the orientation of the head as measured by the head-tracker. In some embodiments the user input may be any suitable user interface input, such as an input from a touchscreen indicating the listening direction or orientation.

There are many potential use cases implemented using the apparatus as described herein. For example a live recording of an unplugged concert may be made with a spatial audio capture apparatus (such as Nokia's OZO). In such a recording the spatial audio capture apparatus (OZO) may be located in the middle of the band where some of the artists move during the concert. Furthermore instruments and singers may be equipped with external (close) microphones and radio tags which may be tracked (by the spatial audio capture apparatus) to obtain object spatial metadata. The external (close) microphone signals allow any rendering device to enhance the perceived clarity/quality of the instruments, and enable the rendering or mixing to adjust the balance between the instruments and background ambience (for example any audience noise, etc.).

Thus for example where the spatial audio capture apparatus such as the OZO device provides 8 array microphone signals, and there are 5 external (close) microphones audio signals. Thus the capture apparatus may, if it was performing according to the prior art, send all spatial audio capture (OZO) device channels and external (close) microphone channels, with associated metadata for each channel. Thus in total there may be 13 audio channels+spatial metadata (1 Direction of Arrival for the analysed spatial audio signals source metadata, 5 external microphone [object] layers).

The spatial analysis may be performed based on the spatial audio capture apparatus (OZO) signals. For transmission, the audio signal channels may be encoded using AAC, and the spatial metadata may be embedded into the bit stream. The object inserter and the metadata processor such as described herein may be configured to: combining the external microphone (object) signals to the spatial audio capture apparatus microphone signals. Thus in some embodiments the output is 8 audio channels+spatial metadata (6-direction of arrival values [1 spatial and 5 external microphone] metadata). This clearly produces a significantly reduced overall bit rate, and somewhat lower decoder complexity.

It may be possible to further reduce the transmitted channels by applying a pre-processing such as omitting some of the spatial audio capture device microphone channels, or generating a 'downmix' of channels. The reproduction quality can for example be preserved, e.g., for N=4 channels.

Although this example is described with respect to a concert it is understood that the capture apparatus may be employed in other similar recording conditions, in which the total number (spatial and external microphone) of transmitted channels can be reduced. For example a news field report may employ a spatial audio capture device at the scene and an external (close) microphone may be worn or held or positioned at a local reporter at the scene, and an external microphone from a studio reporter. A further example may be a sports event where the spatial audio capture device is located within the audience, a first external microphone is configured to capture to capture a commentator audio at the track side, further external microphones are located near the field, and further microphones capturing the players or coach audio. Another example is a theatre (or opera) where spatial audio capture device is located near the stage, and external microphones are located or associated with the actors and near the orchestra.

Figure 9:
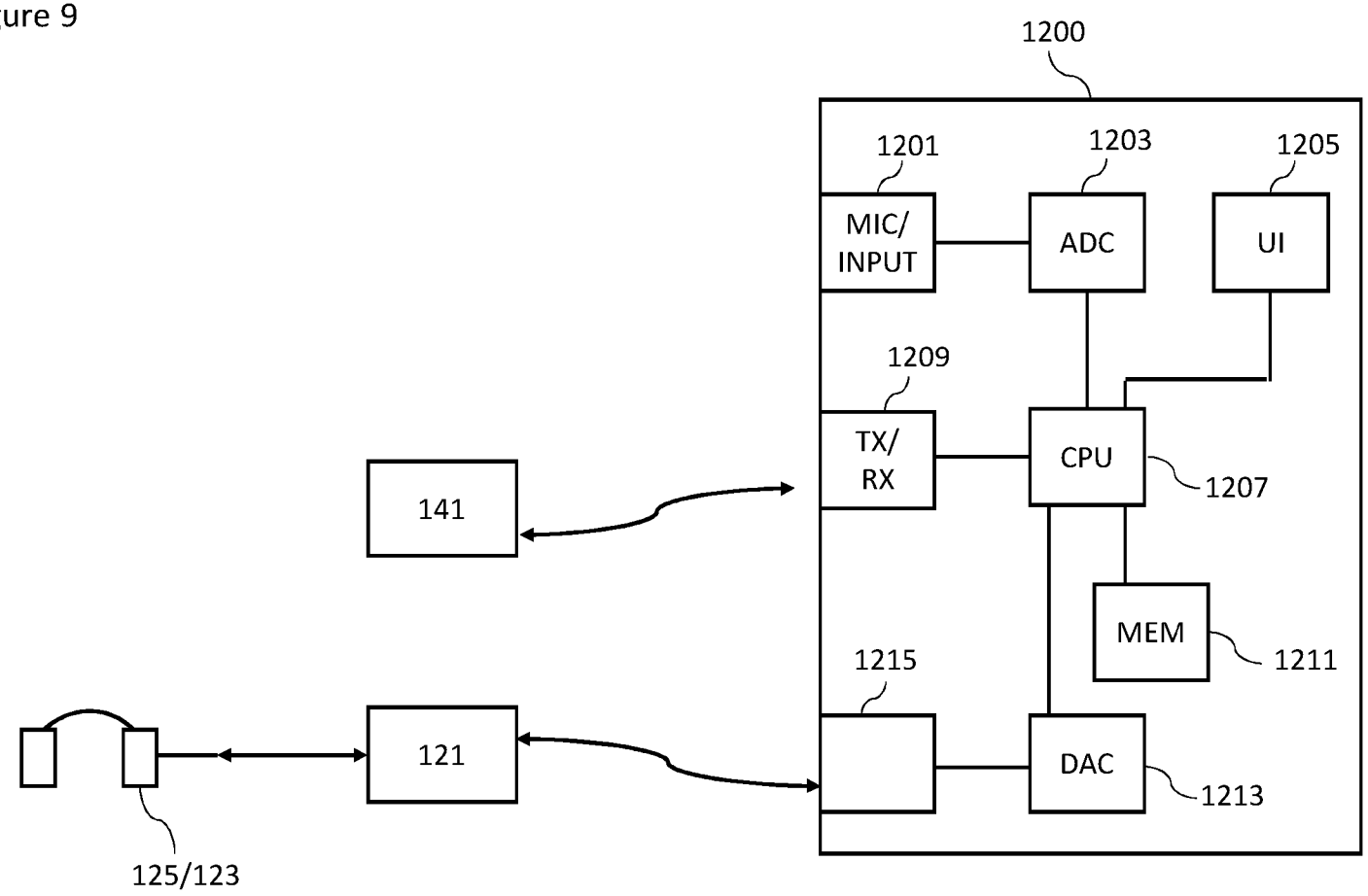
FIG. 9 shows schematically an example device suitable for implementing apparatus shown in FIGS. 1 to 6.

With respect to FIG. 9 an example electronic device which may be used as the external microphone, the SPAC device, the metadata and audio signal generator, the render device or any combination of these components is shown. The device may be any suitable electronics device or apparatus. In the following examples the example electronic device may function both as the spatial capture device and the metadata and audio signal generator combined. For example in some embodiments the device 1200 is a mobile device, user equipment, tablet computer, computer, audio playback apparatus, etc.

The device 1200 may comprise a microphone array 1201. The microphone array 1201 may comprise a plurality (for example a number Q) of microphones. However it is understood that there may be any suitable configuration of microphones and any suitable number of microphones. In some embodiments the microphone array 1201 is separate from the apparatus and the audio signals transmitted to the apparatus by a wired or wireless coupling. The microphone array 1201 may thus in some embodiments be the SPAC microphone array 145 as shown in FIG. 1.

The microphones may be transducers configured to convert acoustic waves into suitable electrical audio signals. In some embodiments the microphones can be solid state microphones. In other words the microphones may be capable of capturing audio signals and outputting a suitable digital format signal. In some other embodiments the microphones or microphone array 1201 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphones can in some embodiments output the audio captured signal to an analogue-to-digital converter (ADC) 1203.

The SPAC device 1200 may further comprise an analogue-to-digital converter 1203. The analogue-to-digital converter 1203 may be configured to receive the audio signals from each of the microphones in the microphone array 1201 and convert them into a format suitable for processing. In some embodiments where the microphones are integrated microphones the analogue-to-digital converter is not required. The analogue-to-digital converter 1203 can be any suitable analogue-to-digital conversion or processing means. The analogue-to-digital converter 1203 may be configured to output the digital representations of the audio signals to a processor 1207 or to a memory 1211.

In some embodiments the device 1200 comprises at least one processor or central processing unit 1207. The processor 1207 can be configured to execute various program codes. The implemented program codes can comprise, for example, SPAC control, spatial analysis, audio signal pre-processing, and object combination and other code routines such as described herein.

In some embodiments the device 1200 comprises a memory 1211. In some embodiments the at least one processor 1207 is coupled to the memory 1211. The memory 1211 can be any suitable storage means. The memory 1211 may comprise a program code section for storing program codes implementable upon the processor 1207. Furthermore the memory 1211 may further comprise a stored data section for storing data, for example data that has been processed or to be processed in accordance with the embodiments as described herein. The implemented program code stored within the program code section and the data stored within the stored data section can be retrieved by the processor 1207 whenever needed via the memory-processor coupling.

In some embodiments the device 1200 comprises a user interface 1205. The user interface 1205 can be coupled in some embodiments to the processor 1207. The processor 1207 may control the operation of the user interface 1205 and receive inputs from the user interface 1205. The user interface 1205 may enable a user to input commands to the device 1200, for example via a keypad. In some embodiments the user interface 205 can enable the user to obtain information from the device 1200. For example the user interface 1205 may comprise a display configured to display information from the device 1200 to the user. The user interface 1205 may comprise a touch screen or touch interface capable of both enabling information to be entered to the device 1200 and further displaying information to the user of the device 1200.

In some embodiments the device 1200 comprises a transceiver 1209. The transceiver 1209 may be coupled to the processor 1207 and configured to enable a communication with other apparatus or electronic devices, for example via a wireless communications network. The transceiver 1209 or any suitable transceiver or transmitter and/or receiver means can in some embodiments be configured to communicate with other electronic devices or apparatus via a wire or wired coupling.

For example as shown in FIG. 9 the transceiver 1209 may be configured to communicate with the render apparatus or may be configured to receive audio signals from the external microphone and tag (such as shown in FIG. 2 by reference 281).

The transceiver 1209 can communicate with further apparatus by any suitable known communications protocol. For example the transceiver 1209 or transceiver means may use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

The device 1200 may be employed as a render apparatus. As such the transceiver 1209 may be configured to receive the audio signals and positional information from the capture apparatus, and generate a suitable audio signal rendering by using the processor 1207 executing suitable code. The device 1200 may comprise a digital-to-analogue converter 1213. The digital-to-analogue converter 1213 may be coupled to the processor 1207 and/or memory 1211 and be configured to convert digital representations of audio signals (such as from the processor 1207 following an audio rendering of the audio signals as described herein) to a suitable analogue format suitable for presentation via an audio subsystem output. The digital-to-analogue converter (DAC) 1213 or signal processing means can in some embodiments be any suitable DAC technology.

Furthermore the device 1200 may comprise an audio subsystem output 1215. An example as shown in FIG. 9 the audio subsystem output 1215 is an output socket configured to enabling a coupling with headphones. However the audio subsystem output 1215 may be any suitable audio output or a connection to an audio output. For example the audio subsystem output 1215 may be a connection to a multichannel speaker system.

In some embodiments the digital to analogue converter 1213 and audio subsystem 1215 may be implemented within a physically separate output device. For example the DAC 1213 and audio subsystem 1215 may be implemented as cordless earphones communicating with the device 1200 via the transceiver 1209.

Although the device 1200 is shown having both audio capture and audio rendering components, it would be understood that the device 1200 may comprise just the audio capture or audio render apparatus elements.

Figure 10:
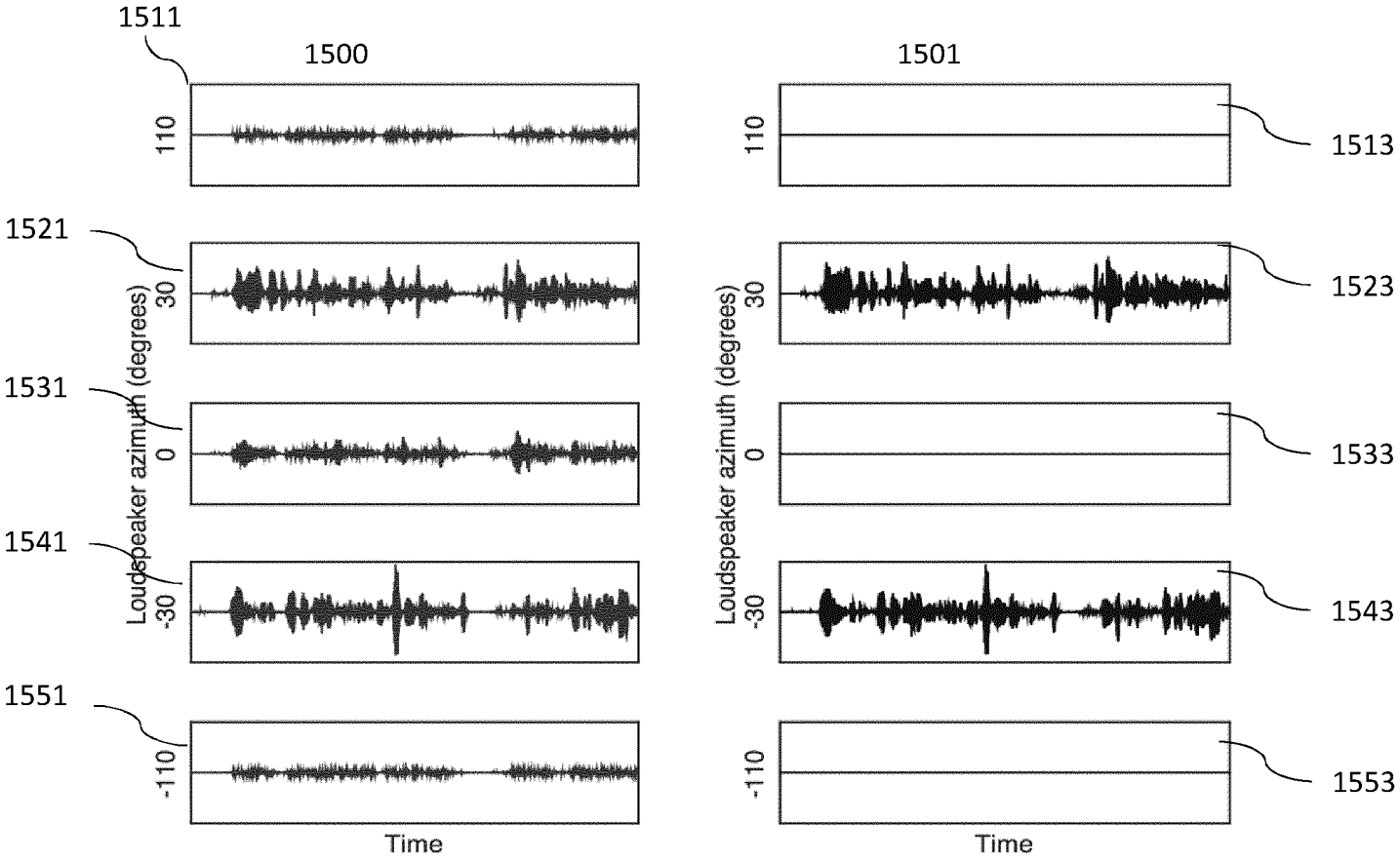
FIG. 10 shows an example output generated by embodiments compared to a prior art output.

In the following an example is given of the benefit of the merging process described herein over the straightforward merging process where the object signals are added to the array-signals before the SPAC analysis, i.e., without the metadata expansion. With respect to FIG. 10 an example scenario where in a sound field there is one active source located at −30 degrees with respect to the spatial audio capture device, and an external microphone (object) source is in-mixed at 30 degrees. In the following example the spatial audio format (the output loudspeaker setup) is assumed to be a standard 5.0 channel format. Thus the speaker/signal output positions shown are for 110 degrees 1511, 1513, 30 degrees 1521, 1523, 0 degrees 1531, 1533, −30 degrees 1541, 1543 and −110 degrees 1551, 1553. FIG. 5 furthermore shows an audio amplitude over time where the spatial capture audio signal and external microphone signals are mixed together only (FIG. 5 left column 1500). This mix produces a spatial analysis/reproduction which suffers from spatial leakage of the sound energy due to the fluctuation in the directional estimate as shown by the amplitude output at 110 degrees 1511, 0 degrees 1531 and −110 degrees 1551. However, if the directional and energetic parameters of the added external microphone (object) source are injected to the parameter stream as proposed in the embodiments as described, an example decoding enables an output (FIG. 10 right column 1501) where the original source and the mixed external microphone source do not spatially interfere with each other as shown by the amplitude output at 110 degrees 1513, 0 degrees 1533 and −110 degrees 1553 which have a substantially zero output.

In the examples described herein the spatial audio capture device audio signals are mixed with an external microphone audio signal with an expanded metadata stream output by the addition of the external microphone metadata. It is understood that in some embodiments it may be possible to combine the audio signals and metadata from more than one spatial audio capture device. In other words the audio signals from two sets of microphones are combined and an expanded metadata stream output.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. Apparatus for mixing at least two audio signals, the at least two audio signals associated with at least one parameter, and at least one second audio signal associated with at least one second parameter, wherein the at least two audio signals and the at least one second audio signal are received, wherein the at least two audio signals represent spatial audio capture microphone channels associated with a sound scene and the at least one second audio signal represents an external audio channel separate from the spatial audio capture microphone channels, the apparatus comprising:

a processor configured to generate a combined parameter output based on the at least one second parameter and the at least one parameter; and a mixer configured to generate a combined audio signal with a same number or fewer number of channels as the at least two audio signals and the at least one second audio signal, wherein the combined audio signal is associated with the combined parameter.

2. The apparatus as claimed in claim 1, wherein at least one of the mixer, the processor or a further processor for audio signal mixing is configured to generate at least one mix audio signal based on the at least one second audio signal in order to generate the combined audio signal based on the at least one mix audio signal.

3. The apparatus as claimed in claim 1, wherein the at least one parameter comprises at least one of:

at least one direction associated with the at least two audio signals;

at least one direction associated with a spectral band portion of the at least two audio signals;

at least one signal energy associated with the at least two audio signals; at least one signal energy associated with a spectral band portion of the at least two audio signals;

at least one metadata associated with the at least two audio signals; or at least one signal energy ratio associated with a spectral band portion of the at least two audio signals.

4. The apparatus as claimed in claim 1, wherein the at least one second parameter comprises at least one of:

at least one direction associated with the at least one second audio signal;

at least one direction associated with a spectral band portion of the at least one second audio signal;

at least one second signal energy associated with the at least one second audio signal;

at least one second signal energy associated with a spectral band portion of the at least one second audio signal;

at least one second signal energy ratio associated with the at least one second audio signal;

at least one metadata associated with the at least one second audio signal; or at least one second signal energy ratio associated with a spectral band portion of the at least one second audio signal.

5. The apparatus as claimed in claim 1, further comprising an analyser configured to determine at least one of the at least one parameter or the at least one second parameter.

6. The apparatus as claimed in claim 1, further comprising an analyser wherein the analyser comprises a spatial audio analyser configured to receive the at least two audio signals and determine at least one direction associated with the at least two audio signals and/or a spectral band portion of the at least two audio signals.

7. The apparatus as claimed in claim 6, wherein the processor is configured to append at least one direction associated with the at least one second audio signal and/or a spectral band portion of the at least one second audio signal to the at least one direction associated with the at least two audio signals and/or the spectral band portion of the at least two audio signals to generate combined spatial audio information.

8. The apparatus as claimed in claim 6, wherein the analyser is configured to at least one of:

receive the at least two audio signals and determine at least one signal energy and/or at least one signal energy ratio associated with the at least two audio signals and/or the spectral band portion of the at least two audio signals, wherein the at least one signal energy parameter and/or at least one signal energy ratio is associated with the determined at least one direction; or receive the at least one second audio signal and determine at least one second signal energy and/or at least one second signal energy ratio, associated with the at least one second audio signal and/or the spectral band portion of the at least one second audio signal.

9. The apparatus as claimed in claim 8, wherein the processor is configured to append the at least one second signal energy and/or at least one second signal energy ratio associated with the at least one second audio signal and/or the spectral band portion of the at least one second audio signal to the at least one signal energy and/or at least one signal energy ratio associated with the at least two audio signals and/or the spectral band portion of the at least two audio signals to generate combined signal energy information.

10. The apparatus as claimed in claim 2, wherein the apparatus is configured to generate the at least one mix audio signal based on at least one second signal energy associated with the at least one second audio signal and at least one signal energy associated with the at least two audio signals.

11. The apparatus as claimed in claim 1, where the apparatus is configured to generate a pre-processed audio signal, before being received by the mixer and the processor, to generate a downmix signal.

12. The apparatus as claimed in claim 2, further comprising a microphone arrangement configured to generate the at least two audio signals, wherein the microphone arrangement is positioned relative to a predetermined location.

13. The apparatus as claimed in claim 12, wherein the at least one second audio signal is generated with an external microphone, wherein at least one direction associated with the at least one second audio signal and/or spectral band portion of the at least one second audio signal is the direction of the external microphone relative to the predetermined location.

14. The apparatus as claimed in claim 13, the apparatus comprising a radio receiver configured to receive a radio signal from the external microphone and a direction determiner configured to determine the direction of the external microphone relative to the predetermined location.

15. The apparatus as claimed in claim 1, wherein the mixer is configured to generate the combined audio signal based on at least partially adding the at least one second audio signal to one or more channels of the at least two audio signals.

16. The apparatus as claimed in claim 1, wherein the at least two audio signals representing spatial audio capture microphone channels are received live from a microphone array and the at least one second audio signal representing an external audio channel separate from the spatial audio capture microphone channels is received live from at least one second microphone external to the microphone array.

17. The apparatus as claimed in claim 1, wherein the at least two audio signals, representing spatial audio capture microphone channels, are received from a microphone array and the at least one second audio signal, representing an external audio channel separate from the spatial audio capture microphone channels, is received from at least one second microphone external to the microphone array.

18. The apparatus as claimed in claim 1, wherein the at least two audio signals representing spatial audio capture microphone channels are synthesized audio signals and the at least one second audio signal representing an external audio channel separate from the spatial audio capture microphone channels is at least one second synthesized audio signal external to the at least two synthesized audio signals.

19. The apparatus as claimed in claim 1, wherein the at least two audio signals representing spatial audio capture microphone channels are received from a microphone array and the at least one second audio signal representing an external audio channel separate from the spatial audio capture microphone channels is a synthesized audio signal external to the microphone array.

20. A method for mixing at least two audio signals, the at least two audio signals associated with at least one parameter, and at least one second audio signal associated with at least one second parameter, wherein the at least two audio signals and the at least one second audio signal are received, wherein the at least two audio signals represent spatial audio capture microphone channels associated with a sound scene and the at least one second audio signal represents an external audio channel separate from the spatial audio capture microphone channels, the method comprising:

generating a combined parameter output based on the at least one second parameter and the at least one parameter; and generating a combined audio signal with a same number or fewer number of channels as the at least two audio signals and the at least one second audio signal, wherein the combined audio signal is associated with the combined parameter.

* * * * *